US008727580B2

(12) United States Patent
Takayama et al.

(10) Patent No.: US 8,727,580 B2
(45) Date of Patent: May 20, 2014

(54) ILLUMINATING DEVICE

(75) Inventors: Ryohei Takayama, Kitasaku-gun (JP); Masaki Asai, Kitasaku-gun (JP); Koji Sakai, Kitasaku-gun (JP)

(73) Assignee: Minebea Co., Ltd., Kitasaku-gun (JP)

( * ) Notice: Subject to any disclaimer, the term of this patent is extended or adjusted under 35 U.S.C. 154(b) by 0 days.

(21) Appl. No.: 13/543,027

(22) Filed: Jul. 6, 2012

(65) Prior Publication Data

US 2013/0010454 A1 Jan. 10, 2013

(30) Foreign Application Priority Data

| | | |
|---|---|---|
| Jul. 6, 2011 | (JP) | 2011-150062 |
| Dec. 2, 2011 | (JP) | 2011-264800 |
| Dec. 2, 2011 | (JP) | 2011-264832 |
| Jul. 4, 2012 | (JP) | 2012-150406 |

(51) Int. Cl.
*F21V 5/02* (2006.01)

(52) U.S. Cl.
USPC ..... 362/333; 362/339; 362/84

(58) Field of Classification Search
USPC ..... 362/333, 339, 311.02, 249.02, 84, 545
See application file for complete search history.

(56) References Cited

U.S. PATENT DOCUMENTS

| | | | | |
|---|---|---|---|---|
| 4,823,246 | A * | 4/1989 | Dilouya | 362/328 |
| 7,186,004 | B2 * | 3/2007 | Powell et al. | 362/244 |
| 7,343,714 | B2 * | 3/2008 | Zocco | 52/204.59 |
| 7,484,871 | B2 * | 2/2009 | Boxler | 362/545 |
| 7,575,344 | B2 * | 8/2009 | Lin et al. | 362/339 |
| 7,686,481 | B1 * | 3/2010 | Condon et al. | 362/331 |
| 7,883,226 | B2 * | 2/2011 | Li | 362/84 |
| 7,909,485 | B2 * | 3/2011 | Chuang | 362/330 |

FOREIGN PATENT DOCUMENTS

| | | |
|---|---|---|
| JP | A-2005-49367 | 2/2005 |
| JP | A-2007-220465 | 8/2007 |
| JP | A-2009-158473 | 7/2009 |

* cited by examiner

*Primary Examiner* — Peggy A. Neils
(74) *Attorney, Agent, or Firm* — Oliff PLC

(57) ABSTRACT

An illuminating device has a light source that includes a plurality of light emitting devices and a phosphor; and a lens sheet that stays on an optical axis of the light source, the lens sheet having a plurality of prisms that is symmetrically arranged with respect to the optical axis of the light source. The plurality of prisms is configured at least on a surface of the lens sheet in which to face the light source, and a plurality of light scattering elements is configured at least on a surface of the lens sheet in which not to face the light source.

21 Claims, 14 Drawing Sheets

Concave

ILLUMINATING DEVICE

BACKGROUND OF THE INVENTION

1. Field of the Invention

The present invention relates to an illuminating device.

2. Description of Related Art

Conventionally, an incandescent lamp or a fluorescent lamp is generally used as a light source for general lighting such as room lighting. In recent years, due to increase in performance of a blue light-emitting diode (LED), such a light emitting diode has been used as a light source of a ceiling lamp, downlighting and the like (see Japanese Patent Application Laid-Open No. 2007-220465).

FIG. 14 illustrates a so-called pseudo white LED 100 that can be used as a light source of an illuminating device. The pseudo white LED 100 has a lamp house 104 and transparent resin 106. A plurality of blue light-emitting diodes 102 as light emitting devices is arranged adjacent to each other on a bottom portion of the lamp house 104. A concave portion of the lamp house 104 is sealed by the transparent resin 106. Moreover, yellow phosphor 108 such as garnet (YAG) is dispersed in the transparent resin 106. Blue light emitted by the respective blue light-emitting diodes 102 is diffused in the transparent resin 106 of the lamp house 104, where a wavelength of the blue light is converted by the yellow phosphor 108 into fluorescent yellow light. Then, the light is output as outgoing light L (L1, L2) as represented by a chain double-dashed line for the sake of convenience, to the outside of the lamp house 104. In addition, a reference numeral 103 in FIG. 14 denotes an electrode terminal.

Moreover, as illustrated in FIG. 15, a lens sheet 110 is arranged in front of the pseudo white LED 100. The outgoing light L from the pseudo white LED 100 is deflected by the lens sheet 110 to a desired direction, which enables a function as the illuminating device. The lens sheet 110 shown in FIG. 15 has a first lens group 112 and a second lens group 114. As seen from an optical axis C of the pseudo white LED 100 as a center, the second lens group 114 is arranged on an outer side of the first lens group 112, and the first lens group 112 is arranged on an inner side of the second lens group 114. The first lens group 112 has a refraction prism. The second lens group 114 has a reflection (TIR: Total Internal Reflection) prism lens.

An output angle of the outgoing light L from the pseudo white LED 100 is deflected by both the first lens group 112 and the second lens group 114 to a direction parallel to the optical axis C.

Regarding the light emitting by the illuminating device using the pseudo white LED 100 as the light source as described above, there is the following tendency; that is, when the optical axis C of the pseudo white LED 100 is considered as a center, a central portion is slightly tinged with blue and an outer portion is slightly tinged with yellow. The reason is as follows. In FIG. 14, the outgoing light L1 follows a light path that is parallel to the optical axis C of the pseudo white LED 100, while the outgoing light L2 follows a light path that is inclined with respect to the optical axis C of the pseudo white LED 100. Therefore, the outgoing light L2 passes through the transparent resin 106 in which the yellow phosphor 108 is dispersed for a longer light path length and thus a rate of the wavelength conversion to fluorescent yellow light due to the yellow phosphor 108 becomes higher, as compared with the outgoing light L1.

In addition, in the above illuminating device, the pseudo white LED 100 having the plurality of blue light-emitting diodes 102 arranged adjacent to each other is used as the light source. In this case, the light emitting by the illuminating device may cause color unevenness called "chip appearance" on an irradiated area. This is a visible phenomenon caused by a series of light with high chromaticity and high brightness among the outgoing light from the respective blue light-emitting diodes 102 on the irradiated area.

Such the color unevenness of the illumination light causes deterioration of quality. This is not a matter in a case of a conventional illuminating device using an incandescent lamp or a fluorescent lamp but peculiar to the illuminating device using the pseudo white LED 100 as the light source.

SUMMARY OF THE INVENTION

The present invention has been made in view of the problems described above, and an object of the invention is to reduce color unevenness without deteriorating brightness of illumination light of an illuminating device.

Aspects of the present invention described hereinafter are just examples of a configuration of the present invention and described for facilitating understanding of a variety of configurations of the present invention. Each aspect does not limit the technical scope of the present invention. Each aspect may be modified by replacing or deleting a part of components of each aspect or adding another component, and such the modification also belongs to the technical scope of the present invention.

In order to achieve the object described above according to a first aspect of the present invention, there is provided an illuminating device comprising: a light source that includes a plurality of light emitting devices and a phosphor; and a lens sheet that stays on an optical axis of the light source, the lens sheet having a plurality of prisms that is symmetrically arranged with respect to the optical axis of the light source, wherein the plurality of prisms is configured at least on a surface of the lens sheet in which to face the light source, and a plurality of light scattering elements is configured at least on a surface of the lens sheet in which not to face the light source.

With this structure, the illuminating device has the light source including the plurality of light emitting devices; and phosphor receiving light emitted by the light emitting devices and emitting the light after converting the wavelength. The outgoing light from the light source is input to the lens sheet located on the optical axis of the light source. When light is introduced into the lens sheet, the optical path of light will be deflected by means of the plurality of prisms. The prisms are provided on the surface of the lens sheet in which to face the light source and to be symmetrically arranged with respect to the optical axis of the light source. Then, light that has been deflected will be introduced into the lens sheet so as to reach the plurality of light scattering elements provided on the surface of the lens sheet in which not to face the light source. When light passes through the light scattering elements and is emitted out therefrom, light is scattered in various directions thereby reducing light directivity. Thus, color mixture of the outgoing light that has been emitted through the lens sheet will be advanced.

Further, in this first aspect of the present invention, the plurality of prisms may be formed on the surface of the lens sheet in which not to face the light source. Still further, the plurality of light scattering elements is allowed to be on the surface of the lens sheet in which to face the light source. In these structures, the following functional effects are additionally obtainable. When light passes through an area with the plurality of light scattering elements that is arranged on the lens sheet in which to face the light source, light directivity is reduced while being diffused in various directions. Moreover, when light has advanced in the lens sheet and passes through an area with the plurality of prisms that is arranged on the lens sheet in which not to face the light source, the optical path of light will be deflected in a specific direction depending on the configuration of each prism. As the same, the color mixture will be further advanced.

Still further, in this first aspect, the plurality of prisms and the plurality of light scattering elements are applicable on both main surfaces of the lens sheets. In this case, when light passes through the both surfaces of the lens sheet on which the plurality of prisms are formed, the optical path of light will be deflected in a direction depending on the configuration of each prism. On the other hand, when light passes through an area on which the plurality of light scattering elements is formed, light directivity is reduced while being diffused in various directions. As the same, the color mixture will be yet advanced.

In the illuminating device according to the first aspect, the plurality of light scattering elements of the lens sheet is formed in a region adjacent to the optical axis of the light source.

With this structure, the plurality of light scattering elements provided on the lens sheet is formed in a region adjacent to the optical axis of the light source. Therefore, a series of outgoing light from the plurality of light emitting devices that is output from near the optical axis of the light source can be especially scattered in various directions and output from the lens sheet. Thus, the color mixture is facilitated through synergistic effects of the outgoing light that has been emitted from the light source, that is, between the light output at the region with the light scattering elements and the light output at the region without the light scattering elements.

In the illuminating device according to the first aspect, the plurality of light scattering elements is formed at an outer edge region on the lens sheet relative to the optical axis of the light source.

With this structure, the plurality of light scattering elements formed on the lens sheet is configured as that the light scattering elements surround the prisms. Accordingly, light that passes through the region will have less directivity and is able to be dispersed in various directions. Through synergistic effects between light that has passed through the region with the light scattering elements and light that has passed through the region without the light scattering elements, an advanced color mixture expects to be achieved.

In the illuminating device according to the first aspect, the plurality of light scattering elements each has a configuration that includes a dome shape.

With this structure, each of the plurality of light scattering elements provided on the lens sheet includes a dome shape so as to achieve the above-mentioned functional effects.

In the illuminating device according to the first aspect, the plurality of light scattering elements includes a plurality of cylindrical lenses arranged concentrically with respect to the optical axis of the light source.

With this structure, the plurality of light scattering elements provided on the lens sheet includes the plurality of cylindrical lenses arranged concentrically with respect to the optical axis of the light source. By adjusting sectional curvature and interval of the plurality of cylindrical lenses, the light output from the opposite surface is controlled in its spread angle while it is scattered in various directions. Thus, the color mixture is facilitated with suppressing the spread angle of the outgoing light from the light source output through the lens sheet.

Moreover, the plurality of prisms formed on the facing surface is arranged symmetrically with respect to the optical axis of the light source, and the plurality of cylindrical lenses formed on the opposite surface is arranged concentrically with respect to the optical axis of the light source, namely, concentric lenticular lenses are provided. Therefore, the outgoing light from the light source output through the lens sheet has an illumination distribution having excellent rotational symmetry with respect to the optical axis of the light source.

In the illuminating device according to the first aspect, the plurality of cylindrical lenses includes certain cylindrical lenses having a sectional curvature that is different from other cylindrical lenses adjacent thereto.

With this structure, the plurality of cylindrical lenses formed on the lens sheet includes a cylindrical lens whose sectional curvature is different from that of an adjacent cylindrical lens. For example, when the sectional curvature of the cylindrical lens is changed depending on distance from the optical axis of the light source, the spread angle of the outgoing light can be controlled depending on chromaticity distribution of the outgoing light from the light source. As another example, when the sectional curvature of the cylindrical lens is set in a random manner as appropriate, the outgoing light from the light source output through a region in which the cylindrical lenses are formed is subject to color mixture in a random manner in that region. Furthermore, the color mixture is facilitated by an effect of superposition with the outgoing light from the light source that is output through a region in which the cylindrical lenses are not formed.

In the illuminating device according to the first aspect, each of the plurality of cylindrical lenses is a convex cylindrical lens.

With this structure, each of the plurality of cylindrical lenses provided on the lens sheet is a convex cylindrical lens so as to achieve the above functional effects.

In the illuminating device according to the first aspect, each of the plurality of cylindrical lenses is a concave cylindrical lens.

With this structure, each of the plurality of cylindrical lenses provided on the lens sheet is a concave cylindrical lens so as to achieve the above functional effects.

In the illuminating device according to the first aspect, the plurality of light scattering elements includes a plurality of micro lenses regularly arranged on a surface orthogonal to the optical axis of the light source.

With this structure, the plurality of light scattering elements provided on the lens sheet includes the plurality of micro lenses regularly arranged on a surface orthogonal to the optical axis of the light source. By adjusting sectional curvature and an arrangement pattern (for example, matrix, oblique grid, concentric and the like) of the plurality of micro lenses, the light output from the opposite surface is controlled in its spread angle while it is scattered in various directions. Thus, the color mixture is facilitated with suppressing the spread angle of the outgoing light from the light source output through the lens sheet.

In the illuminating device according to the first aspect, the plurality of micro lenses is arranged in a houndstooth pattern.

With this structure, the plurality of micro lenses provided on the lens sheet is arranged in a houndstooth pattern. Thus, the micro lenses are more densely arranged. For example, in a case where each of the micro lenses is formed to have a hexagonal shape in a planar view, each micro lens is arranged in close contact with outer periphery of adjacent micro lens. The micro lenses are thus allowed for close arrangement therebetween.

In the illuminating device according to the first aspects, each of the plurality of micro lenses is a convex lens.

With thus structure, each of the plurality of micro lenses provided on the lens sheet is a convex lens so as to achieve the above functional effects.

In the illuminating device according to the first aspect, each of the plurality of micro lenses is a concave lens.

With this structure, each of the plurality of micro lenses provided on the lens sheet is a concave lens so as to achieve the above functional effects.

In the illuminating device according to the first aspect, the lens sheet includes: a first lens group; and a second lens group arranged on an outer side of the first lens group with the optical axis of the light source as a center, wherein the first lens group includes a plurality of prisms each having an inclined surface, which is inclined so as to direct relative to the optical axis of the light source.

With this structure, the lens sheet has the first lens group arranged on the inner side and the second lens group arranged on the outer side thereto in consideration of the optical axis of the light source being as a center. The first lens group has the plurality of prisms each having an inclined surface that is inclined so as to direct relative to the optical axis of the light source. As a result, when the outgoing light from the light source is output from the lens sheet, the light path of the outgoing light is deflected outward as seen from the optical axis of the light source by means of the plurality of prisms. Here, in order to control the deflection direction, the height of the prism may be increased depending on distance from the optical axis of the light source for changing an inclination angle of the inclined surface. In this case, the area of a surface of the prism parallel to the optical axis is increased. However, since the inclined surface of the prism of the first lens group is inclined so as to direct relative to the optical axis of the light source, the outgoing light from the light source is prevented from being directly input to the surface of the prism parallel to the optical axis, which does not cause deterioration in light use efficiency. The color mixture is facilitated by an effect of superposition of the outgoing light from the light source that is output through the first lens group and the outgoing light from the light source that is output through the second lens group arranged on the outer side of the first lens group.

In the illuminating device according to the first aspect, the plurality of prisms of the first lens group is formed such that an inclination angle of the inclined surface decreases with distance from the optical axis of the light source.

With this structure, the plurality of prisms of the first lens group is formed such that the inclination angle of the inclined surface decreases with distance from the optical axis of the light source. Thus, the deflection direction can be controlled depending on the distance from the optical axis of the light source by the plurality of prisms of the first lens group. For example, the inclination angle of the inclined surface of each prism is set to decrease with distance from the optical axis of the light source such that an output angle of the outgoing light from the light source that is output through the first lens group of the lens sheet is constant regardless of the distance from the optical axis of the light source.

In the illuminating device according to the first aspect, the second lens group includes a plurality of reflection prisms.

With this structure, the second lens group includes a plurality of reflection prisms. Therefore, in a region further away from the optical axis of the light source as compared with the first lens group, an output angle of the outgoing light from the light source that is output through the second lens group is deflected toward a direction parallel to the optical axis or a direction closer to the optical axis of the light source. Thus, the color mixture is facilitated by an effect of superposition of the outgoing light from the light source that is output through the first lens group and the outgoing light from the light source that is output through the second lens group arranged on the outer side of the first lens group.

In the illuminating device according to the first aspect, the lens sheet further comprises a third lens group arranged between the first lens group and the second lens group, the third lens group including a plurality of prisms each having an inclined surface that is inclined so as to direct opposite relative to the optical axis of the light source.

With this structure, the outgoing light from the light source is deflected also through the third lens group arranged between the first lens group and the second lens group. Here, since each of the prisms of the third lens group has the inclined surface that is inclined so as to direct opposite relative to the optical axis of the light source, the outgoing light from the light source is deflected when irradiated onto the inclined surface of the third lens group and thus the light path of the outgoing light output from the lens sheet is deflected toward a direction parallel to the optical axis of the light source or toward the optical axis of the light source which is opposite to the deflection direction of the outgoing light output through the first lens group. Thus, the color mixture is further facilitated by an effect of superposition of the outgoing light from the light source that is output through the first lens group, the outgoing light from the light source that is output through the second lens group arranged on the outer side of the first lens group, and the outgoing light from the light source that is output through the third lens group arranged between the first lens group and the second lens group.

In the illuminating device according to the first aspect, the second lens group includes a plurality of prisms each having an inclined surface that is inclined so as to direct opposite relative to the optical axis of the light source.

With this structure, the second lens group has the plurality of prisms each having the inclined surface that is inclined so as to direct opposite relative to the optical axis of the light source. Therefore, in a region further away from the optical axis of the light source as compared with the first lens group, the outgoing light from the light source is deflected when irradiated onto the inclined surface of the second lens group and thus the light path of the outgoing light output from the lens sheet is deflected in a direction parallel to the optical axis of the light source or toward the optical axis of the light source which is opposite to the deflection direction of the outgoing light output through the first lens group. Thus, the color mixture is facilitated by an effect of superposition of the outgoing light from the light source that is output through the first lens group and the outgoing light from the light source that is output through the second lens group arranged on the outer side of the first lens group.

In the illuminating device according to the first aspect, the plurality of prisms of each lens group is arranged with respect to the optical axis of the light source in a rotational symmetry.

With this structure, the plurality of prisms of each lens group of the lens sheet is arranged with respect to the optical axis of the light source in a rotational symmetry. Thus, the color mixture of the outgoing light from the light source output through the lens sheet is facilitated in all radial directions from the optical axis of the light source as a center.

In the illuminating device according to the first aspect, the lens sheet has a flat portion provided between each adjacent prism on which the plurality of light scattering elements is formed.

With this structure, for example, in case that the plurality of prisms is formed on the surface of the lens sheet in which not to face the light source, the flat portion is formed between each adjacent prism. The plurality of light scattering elements is formed on the flat portion. Specifically, each prim and the flat portion are concentrically arranged with respect to the optical axis of the light source and also are alternately provided in a radial direction of the lens sheet. Accordingly, light that passes through the lens sheet has: 1) outgoing light to be reflected in a direction depending on the configuration of prisms; and 2) outgoing light that passes through the flat portion placed adjacent to each prism of the lens sheet so as to diffuse in various directions by means of the plurality of light scattering elements. Color mixture is well advanced based on these outgoing lights.

In the illuminating device according to the first aspect, the plurality of light scattering elements is formed on each inclined surface of the prisms.

With this structure, for example, in case that the plurality of prisms is formed on the surface of the lens sheet in which not to face the light source, the plurality of the light scattering elements is formed on each inclined surface of the prisms. When light passes through such prisms, the outgoing light that has been emitted from the light source is deflected in a direction depending on the configuration of each prism. Further, while keeping the deflected direction, the outgoing light is adapted to diffuse in various directions by means of the plurality of light scattering elements. As the same, color mixture is further advanced.

In the illuminating device according to the first aspect, each of the light emitting devices is positioned adjacent to each other.

In this first aspect of the present invention, the light source has the plurality of light emitting devices, each of which is positioned close to each other. In this type of light source, color unevenness called "chip appearance" tends to occur. However, in the first aspect, the plurality of light scattering elements is allowed to be on the lens sheet, which is near the optical axis of the light source. With this structure, outgoing lights that are emitted from the plurality of light emitting devices, especially the lights emitted in a row at an area near the optical axis of the light source, will diffuse in various directions by means of the plurality of light scattering elements. The color unevenness can be thus effectively reduced.

In the illuminating device according to the first aspect, each of the plurality of light emitting devices is a blue light-emitting diode, and the phosphor converts a wavelength of blue light emitted by the blue light-emitting diode into fluorescent yellow light.

With this structure, the light source is a pseudo white light emitting diode in which blue light is emitted by the respective blue light-emitting diodes and the wavelength of the blue light is converted by the phosphor into fluorescent yellow light. Then, the color mixture of the outgoing light emitted by the pseudo white light emitting diode is facilitated by the prisms and the light scattering elements of the lens sheet, as described above. As a result, the color unevenness that has been inevitable when a pseudo white light emitting diode is used can be reduced or resolved.

According to the aspects of the present invention, the color unevenness can be reduced without deteriorating the brightness of the illumination light of the illuminating device.

BRIEF DESCRIPTION OF THE DRAWINGS

FIGS. 1A and 1B are cross-sectional views schematically illustrating a configuration of an illuminating device according to a first embodiment of the present invention, wherein FIG. 1A is a cross-sectional view of an overall configuration, and FIG. 1B is a magnified cross-sectional view of a part of a region of an opposite surface of a lens sheet illustrated in FIG. 1A, wherein the region is adjacent to an optical axis of the light source and dome-shaped light scattering elements are formed in the region;

FIGS. 3A to 3C are cross-sectional views schematically illustrating the lens sheet of the illuminating device illustrated in FIG. 1A, specifically a half of the lens sheet located on one side of the optical axis, wherein FIG. 3A is a cross-sectional view of the lens sheet according to FIG. 1A, FIG. 3B is a cross-sectional view of the lens sheet according to an application example, and FIG. 3C is a cross-sectional view of the lens sheet according to another application example;

FIGS. 6A and 6B are graphs partially extracted from the graph shown in FIG. 5, wherein FIG. 6A shows a range related to the outgoing light output through the first lens group of the lens sheet, and FIG. 6B shows a range related to the outgoing light output through a second lens group of the lens sheet;

FIGS. 9A and 9B are cross-sectional views illustrating light path of outgoing light from the light source around a portion of the lens sheet apart from the optical axis of the light source, wherein FIG. 9A shows a case of the lens sheet of the illuminating device illustrated in FIG. 8A, and FIG. 9B shows a case of a lens sheet according to a comparative example;

FIGS. 11A and 11B are cross-sectional views illustrating light path of outgoing light from the light source around a portion of the lens sheet apart from the optical axis of the light source, wherein FIG. 11A shows a case of the lens sheet of the illuminating device illustrated in FIG. 10A, and FIG. 11B shows a case of a lens sheet according to a comparative example;

FIG. 13 is sectional views illustrating another examples of the lens sheets that are applicable in the illuminating device of the present invention, where

DETAILED DESCRIPTION OF THE EMBODIMENTS

Figure 1A:
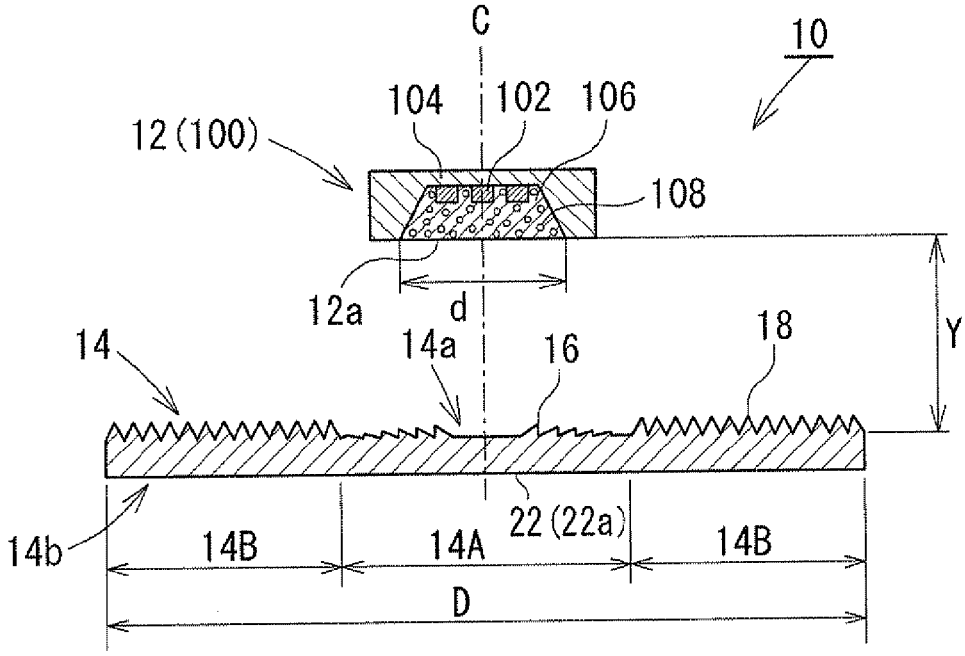

Embodiments of the present invention will be described below with reference to the attached drawings. Here, the same reference numerals are given to the same components as those described above and some redundant descriptions will be omitted as appropriate.

Figure 14:
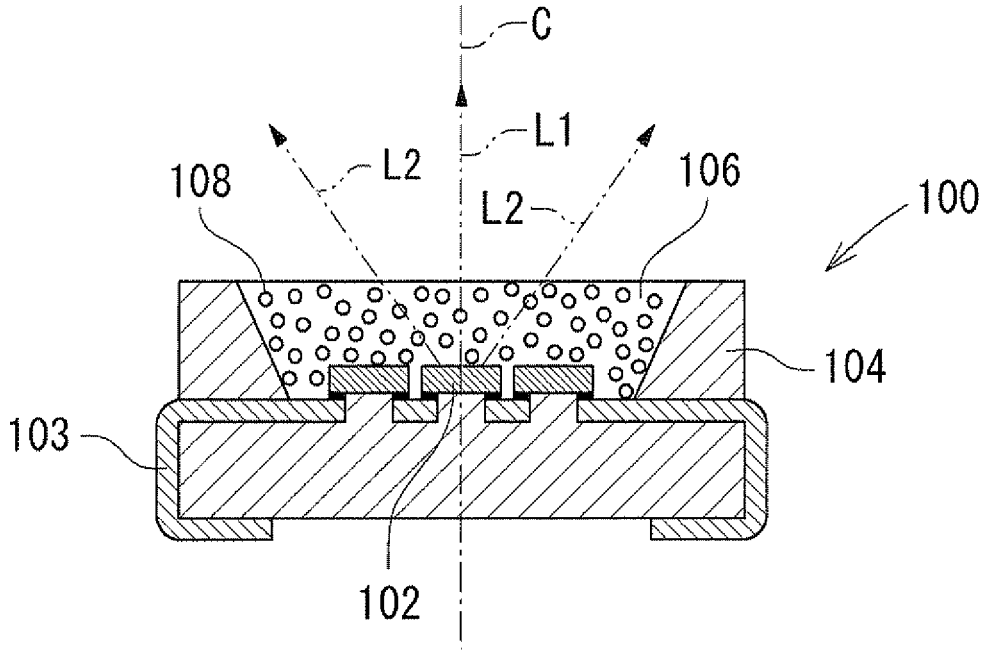
FIG. 14 is a cross-sectional view illustrating a pseudo white LED and outgoing light.

As shown in FIG. 1A, an illuminating device 10 according to a first embodiment of the present invention has a light source 12 and a lens sheet 14. The lens sheet 14 has a plurality of prisms arranged symmetrically with respect to an optical axis C of the light source 12. The lens sheet 14 further has a plurality of light scattering elements 22 formed in a circular region adjacent to the optical axis C of the light source 12. The light source 12 has a configuration of a pseudo white LED 100 similar to that shown in FIG. 14, and the same reference numerals are given to the same components as those described in FIG. 14. In the example shown in FIG. 1A, the light source 12 is exemplified by the pseudo white LED 100 in which three blue light-emitting diodes 102 are arranged. In the light source of the illuminating device according to the present embodiment, the number of blue light-emitting diodes 102 is from three to several dozen and arrangement pitch thereof is set to be about 0.25 mm.

The lens sheet 14 is located in front (in a light output direction) of a light emitting surface 12*a* of the light source 12. The lens sheet 14 has a facing surface 14*a* fronting toward the light source 12, and a first lens group 14A and a second lens group 14B are formed on the facing surface 14*a*. As seen from the optical axis C of the light source 12 as a center, the second lens group 14B is arranged on an outer side of the first lens group 14A, and the first lens group 14A is arranged on an inner side of the second lens group 14B. Moreover, the lens sheet 14 is formed to have a disk shape whose center is at the optical axis C of the light source 12. Each of the lens groups 14A and 14B has a plurality of prisms (described later), and the plurality of prisms is formed near the optical axis C of the light source 12 in a rotational symmetry.

Moreover, the lens sheet 14 has an opposite surface 14*b*, the other surface of the lens sheet 14 opposite to the facing surface 14*a*, and the plurality of light scattering elements 22 is formed on the opposite surface 14*b*. Specifically, the plurality of light scattering elements 22 is formed in a circular region around the optical axis C of the light source 12 and adjacent to the optical axis C of the light source 12. Here, the light scattering element 22 according to the present embodiment is a dome-shaped light scattering element 22*a* as illustrated in a magnified manner in FIG. 1B.

Furthermore, the illuminating device 10 has a reflector having a bowl shape or a bottomed cylindrical shape and covering the outside of the light source 12 and the lens sheet 14.

Here, a diameter D of the lens sheet 14 according to the present embodiment is preferably set to be equal to or larger than 20 mm. A diameter of the circular region in which the dome-shaped light scattering elements 22*a* are formed is preferably set in consideration of the diameter D of the lens sheet 14. For example, when the diameter D of the lens sheet 14 is set to be 20 mm, the diameter of the circular region, in which the dome-shaped light scattering elements 22*a* are formed, is set to be 20 mm equal to the diameter D of the lens sheet 14. In this case, the dome-shaped light scattering elements 22*a* are formed on an entire surface of the opposite surface 14*b*. As another example, when the diameter D of the lens sheet 14 is set to be 65 mm, the diameter of the circular region in which the dome-shaped light scattering elements 22*a* are formed is set to be about 15 mm. As still another example, when the diameter D of the lens sheet 14 is set to be 100 mm, the diameter of the circular region in which the dome-shaped light scattering elements 22*a* are formed is set to be about 20 mm.

Moreover, a dome diameter of the dome-shaped light scattering element 22*a* is set to be about 0.07 mm. A density of the dome-shaped light scattering elements 22*a* with respect to the circular region, in which the dome-shaped light scattering elements 22*a* are formed, is set to be about 80%.

Figure 2:
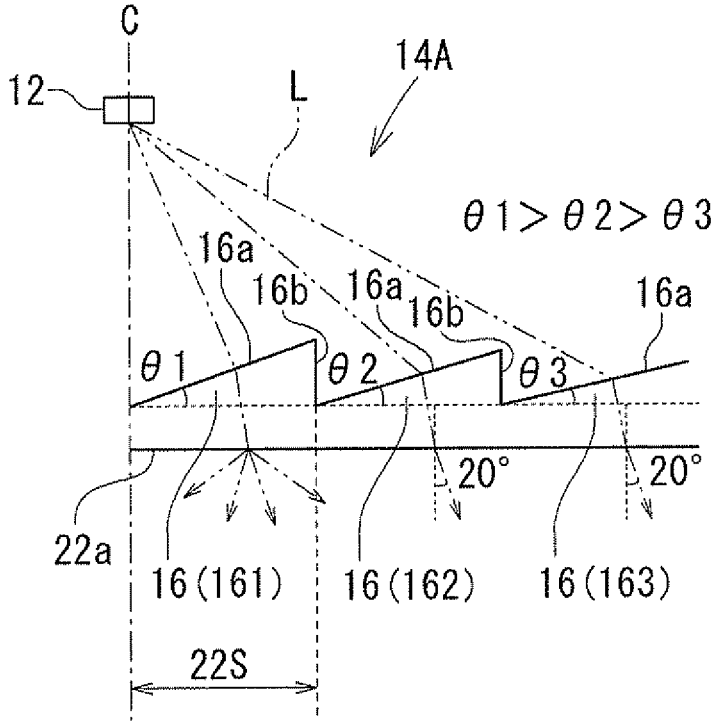
FIG. 2 shows a first lens group of the lens sheet of the illuminating device illustrated in FIG. 1A, specifically a half of the first lens group located on one side of the optical axis, wherein the first lens group is arranged in an inner area when the optical axis of the light source is considered as a center.

FIG. 2 shows the first lens group 14A of the lens sheet 14 of the illuminating device 10 illustrated in FIG. 1A that is formed on the facing surface 14*a*, specifically a half of the first lens group 14A located on one side of the optical axis C of the light source 12. As illustrated in a magnified manner, the first lens group 14A has a plurality of prisms 16 each having an inclined surface 16*a* that is inclined so as to direct relative to the optical axis C of the light source 12. In the present embodiment, the first lens group 14A having the plurality of prisms 16 each having the inclined surface 16*a* that is inclined so as to direct relative to the optical axis C of the light source 12 may be referred to as a "concave Fresnel lens".

As illustrated in FIG. 2, the plurality of prisms 161, 162, 163 . . . of the first lens group 14A is formed such that respective inclination angles θ1, θ2, θ3 . . . of the inclined surfaces 16*a* decrease with distance from the optical axis C of the light source 12 (θ1>θ2>θ3). In the example illustrated in FIGS. 1 and 2, a distance Y between the light emitting surface 12*a* of the light source 12 and the facing surface 14*a* of the lens sheet 14 (or an angle between the optical axis C and an imaginary line connecting between the light emitting surface 12*a* and the facing surface 14*a*) is taken into consideration, and the respective inclination angles θ1, θ2, θ3 . . . of the inclined surfaces 16*a* of the prisms 161, 162, 163 . . . are set such that an output angle of outgoing light from the light source 12 that is output through the first lens group 14A is a constant value of 20° regardless of the distance from the optical axis C of the light source 12. It should be noted that the respective inclination angles θ1, θ2, θ3 . . . of the inclined surfaces 16*a* of the prisms 161, 162, 163 . . . can be easily calculated by a well-known relational expression.

Here, in the example shown in FIG. 2, the dome-shaped light scattering elements 22*a* are formed in a region 22S provided on the opposite surface 14*b*, the region 22S is a circular region around the optical axis C of the light source 12, and a diameter of region 22S is set to be substantially equal to a diameter of a region in which the prism 161 is formed. Therefore, the outgoing light from the light source 12 that passes through the prism 161 of the first lens group 14A on the facing surface 14*a* and further passes through the circular region 22S in which the dome-shaped light scattering elements 22*a* (see FIG. 1B) are formed on the opposite surface 14*b* is output in various directions. On the other hand, the outgoing light from the light source 12 that passes through the first lens group 14A on the facing surface 14*a* but does not pass through the circular region 22S in which the dome-shaped light scattering elements 22*a* are formed on the opposite surface 14*b* is output with the output angle of 20°.

Meanwhile, the second lens group 14B (see FIG. 1A) of the lens sheet 14 has a plurality of reflection prisms 18.

In the first embodiment of the present invention, the distance Y between the light emitting surface 12*a* of the light source 12 and the facing surface 14*a* of the lens sheet 14 is set to be substantially equal to a diameter d of the light emitting surface 12*a* of the light source 12. However, it is preferable to set the distance Y in a range $0.5\ d \le y \le 1.5\ d$ for reducing color unevenness without deteriorating brightness of illumination light of the illuminating device 10 while facilitating miniaturization of the illuminating device 10. Moreover, it is preferable from the same standpoint to set the diameter D of the lens sheet 14 to be equal to or larger than 20 mm as described above and to further satisfy a condition $\tan^{-1}(D/2Y)<80°$.

Figure 3A:
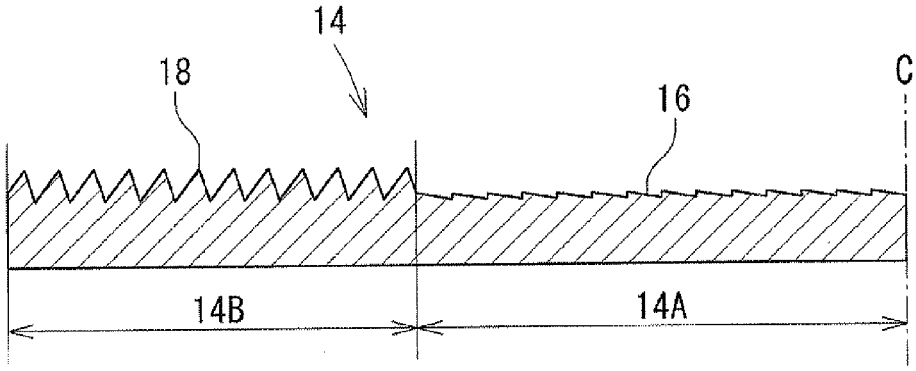
Figure 3B:
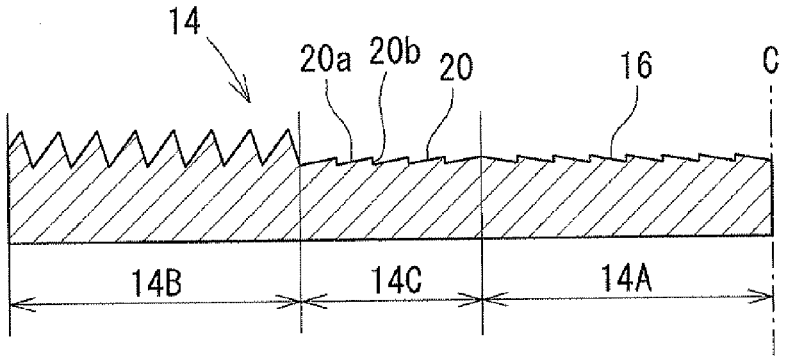
Figure 3C:
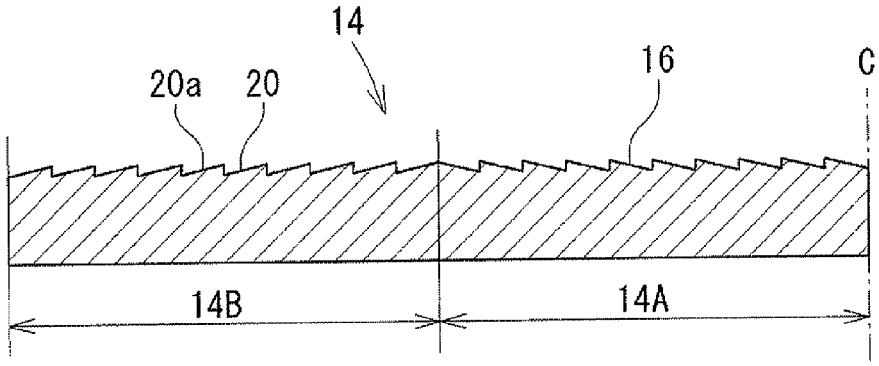

FIGS. 3A to 3C schematically show configuration examples of the lens groups of the lens sheet 14 of the illuminating device 10 according to the first embodiment of the present invention. Note that description of the dome-shaped light scattering elements 22*a* provided on the opposite surface 14*b* is omitted. First, FIG. 3A shows the same configuration as that shown in FIG. 1, description of which is thus omitted.

In the example shown in FIG. 3B, a third lens group 14C is further formed between the first lens group 14A and the second lens group 14B, as compared with the example shown in FIG. 3A. The third lens group 14C has a plurality of prisms 20 each having an inclined surface 20*a* that is inclined so as to direct opposite relative to the optical axis C of the light source 12 (that is, each surface 20*b* faces the optical axis C). In the present embodiment, the third lens group 14C having the plurality of prisms 20 each having the inclined surface 20*a* that is inclined so as to direct opposite relative to the optical axis C of the light source 12 may be referred to as a "convex Fresnel lens".

An arrangement range of the third lens group 14C is as follows. That is, as shown in FIG. 3B, the third lens group 14C may be arranged so as to narrow respective arrangement ranges of the first lens group 14A and the second lens group 14B as compared with the example shown in FIG. 3A. Alternatively, a part of the first lens group 14A, namely a certain range of the first lens group 14A adjacent to the second lens group 14B may be replaced with the third lens group 14C. Alternatively, a part of the second lens group 14B, namely a certain range of the second lens group 14B adjacent to the first lens group 14A may be replaced with the third lens group 14C.

In the example shown in FIG. 3C, the second lens group 14B shown in FIG. 3A is replaced with a convex Fresnel lens having a plurality of prisms 20. Each prism 20 has an inclined surface 20*a* that is inclined so as to direct opposite relative to the optical axis C of the light source 12 as in the case of FIG. 3B.

Here, let us consider a case where the illuminating device 10 is provided with the lens sheet 14 having the configuration shown in FIGS. 1 and 3A. How the light path of the outgoing light L from the light source 12 is deflected when output from the lens sheet 14 will be described below by comparing this case with other configuration examples by reference to FIGS. 4A to 4D. It should be noted that the scattering of the output angle due to the dome-shaped light scattering elements 22*a* is not illustrated in FIGS. 4A to 4D in order to facilitate understanding of the light path deflection by the first lens group 14A.

Figure 4A:
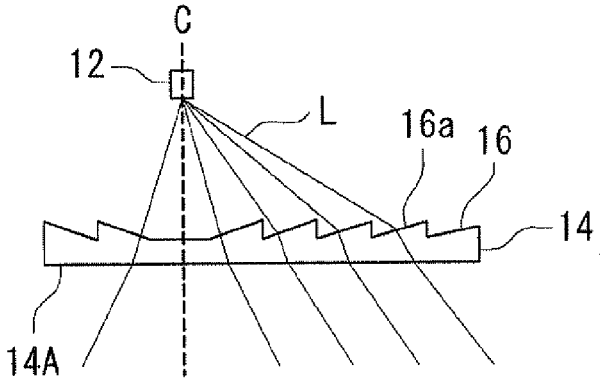
FIG. 4A is a cross-sectional view illustrating light path of outgoing light from the light source output through the first lens group of the lens sheet of the illuminating device illustrated in FIG. 1A, and FIGS. 4B to 4D are cross-sectional views respectively illustrating light paths according to comparative examples.
Figure 15:
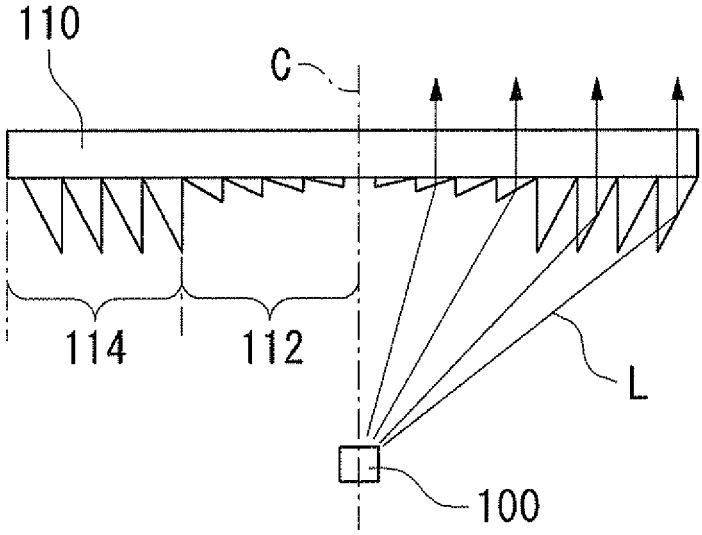
F I G. 1 5 Prior Art
FIG. 15 is a cross-sectional view schematically illustrating a configuration of a typical illuminating device that uses the pseudo white LED as a light source.

First, FIG. 4A shows a case where the plurality of prisms 16 of the first lens group 14A of the lens sheet 14 is the concave Fresnel lens. In this case, when the outgoing light L from the light source 12 is output from the lens sheet 14, the light path of the outgoing light L is deflected outward as seen from the optical axis C of the light source 12 due to deflection at the inclined surface 16*a* of each prism 16 that is inclined so as to direct relative to the optical axis C of the light source 12. Meanwhile, the second lens group 14B (see FIGS. 1A and 3A) arranged on the outer side of the first lens group 14A has the plurality of reflection prisms 18, and a light path of outgoing light output through the plurality of reflection prisms 18 is parallel to the optical axis C of the light source 12 (see FIG. 15). Thus, the color mixture is facilitated by an effect of superposition of the outgoing light L from the light source 12 that is output through the first lens group 14A of the lens sheet 14 and the parallel outgoing light output through the plurality of reflection prisms 18.

Figure 4B:
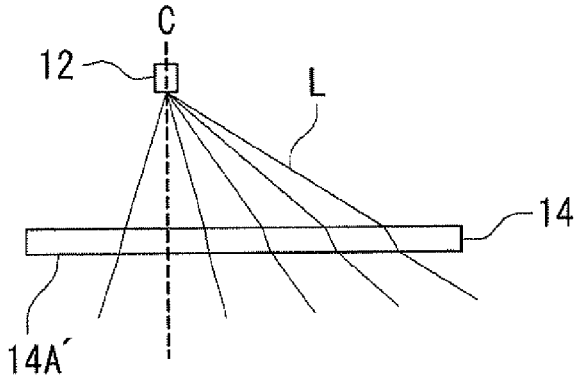

FIG. 4B shows a case where a first lens group 14A' of the lens sheet 14 does not have prisms but is formed to have a planar surface. In this case, although the light path of the outgoing light L is slightly changed due to deflection when the outgoing light L from the light source 12 is input to and output from the lens sheet 14, the input angle and the output angle are substantially equal to each other. Therefore, although the outgoing light L is superposed with the parallel outgoing light that is output through the plurality of reflection prisms 18 of the second lens group 14B arranged on the outer side of the first lens group 14A and parallel to the optical axis C of the light source 12, the effect of the color mixture is not as much as that in the case of FIG. 4A according to the first embodiment of the present invention.

Figure 4C:
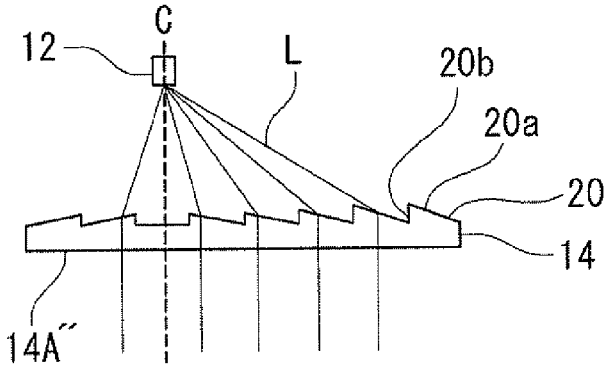

FIG. 4C shows a ease where a first lens group 14A" of the lens sheet 14 is the convex Fresnel lens and the inclination angle of the inclined surface 20*a* of each prism 20 increases with distance from the optical axis C of the light source 12.

In this case, when the outgoing light L from the light source 12 is output from the lens sheet 14, the light path of the outgoing light L is deflected to a direction parallel to the optical axis C of the light source 12 due to deflection at the inclined surface 20*a* of each prism 20 that is inclined so as to direct opposite relative to the optical axis C of the light source 12, which depends on the inclination angle. Even if the inclination angle of the inclined surface 20*a* of each prism 20 is increased, the output angle of the outgoing light L output from the lens sheet 14 cannot be larger in the outward direction as seen from the optical axis C of the light source 12 as compared with the case shown in FIG. 4B where the first lens group 14A' does not have prisms but is formed to have a planar surface. Therefore, the color mixture due to an effect of superposition of the outgoing light L from the light source 12 that is output through the first lens group 14A" of the lens sheet 14 and the parallel outgoing light (see FIG. 15) that is output through the plurality of reflection prisms 18 of the second lens group 14B arranged on the outer side of the first lens group 14A and parallel to the optical axis C of the light source 12 is hardly expected.

Figure 4D:
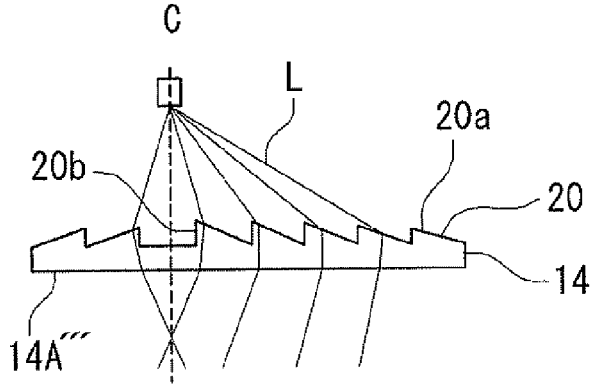

FIG. 4D shows a case where a first lens group 14A'" of the lens sheet 14 is the convex Fresnel lens and the inclination angle of the inclined surface 20*a* of each prism 20 decreases with distance from the optical axis C of the light source 12.

In this case, when the outgoing light L from the light source 12 is output from the lens sheet 14, the light path of the outgoing light L is certainly deflected inward as seen relative to the optical axis C of the light source 12. This is due to the deflection of the outgoing light L at the inclined surface 20*a* of each prism 20 that is inclined so as to direct opposite relative to the optical axis C of the light source 12, which depends on the inclination angle.

However, when the inclination angle of the inclined surface 20*a* is increased in order to enhance the deflection effect, a height of each prism 20 becomes larger accordingly. As a result, a rate of the outgoing light L from the light source 12 that is input to a surface 20*b* parallel to the optical axis C and facing toward the optical axis C of the light source 12 is increased. The light input to the surface 20*b* parallel to the optical axis C and facing toward the optical axis C of the light source 12 is not directed forward as seen from the light emitting surface 12*a* of the light source 12 (see FIG. 1A). That is, the light input to the surface 20*b* does not serve as effective light but becomes stray light, which causes deterioration in light use efficiency.

Thus, in the case of the example shown in FIG. 4D, brightness of illumination light of the illuminating device 10 is deteriorated, although the color mixture due to an effect of superposition of the outgoing light L from the light source 12 that is output through the first lens group 14A''' of the lens sheet 14 and the parallel outgoing light (see FIG. 15) that is output through the plurality of reflection prisms 18 of the second lens group 14B arranged on the outer side of the first lens group 14A and parallel to the optical axis C of the light source 12 is expected.

Here, let us describe a case where the effect of scattering of the output angle due to the dome-shaped light scattering elements 22*a* is added to the example shown in FIG. 4A. In the example shown in FIG. 4A, as described above, the light path of the outgoing light L from the light source 12 is deflected outward as seen from the optical axis C of the light source 12 due to each prism 16 of the first lens group 14A being the concave Fresnel lens. Furthermore, at the opposite surface 14*b* of the lens sheet 14, the light passing through the circular region in which the dome-shaped light scattering elements 22*a* are formed is scattered in various directions (see FIG. 2) and output from the lens sheet 14. Therefore, the color mixture is further facilitated as compared with a case where no dome-shaped light scattering element 22*a* is formed on the opposite surface 14*b* of the lens sheet 14.

Figure 5:
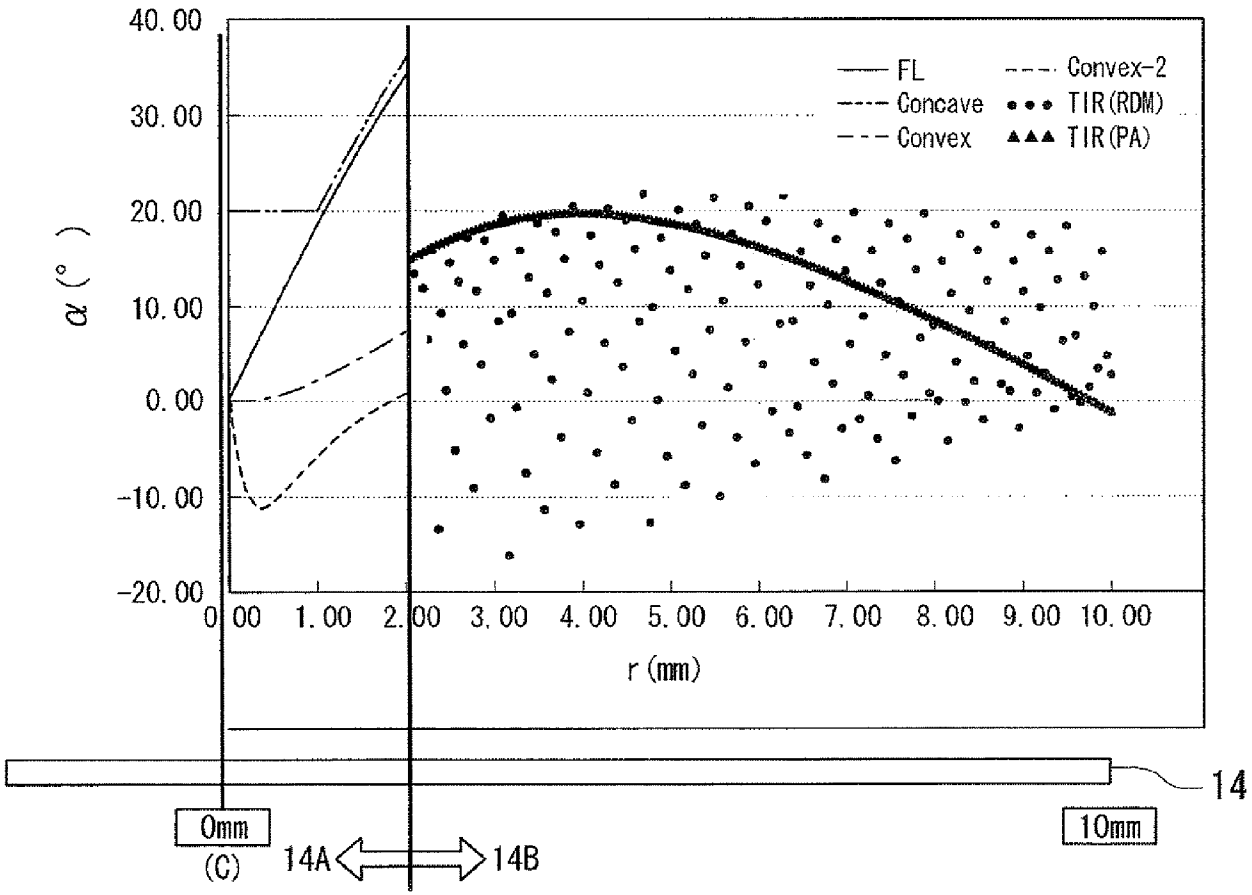
FIG. 5 shows a graph indicating a relationship between an output angle of the outgoing light from the light source output through the lens sheet of the illuminating device illustrated in FIG. 1A and a distance from the optical axis of the light source, together with a schematic view of the lens sheet.
Figure 6A:
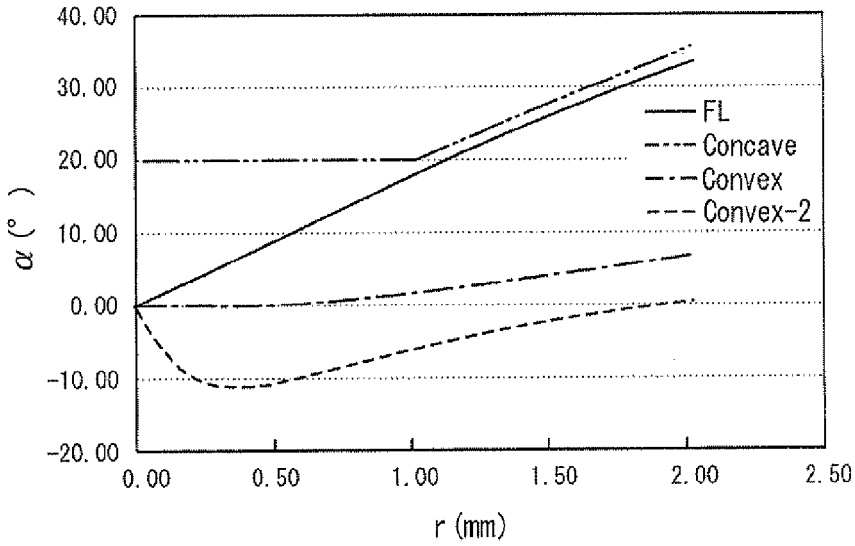
Figure 6B:
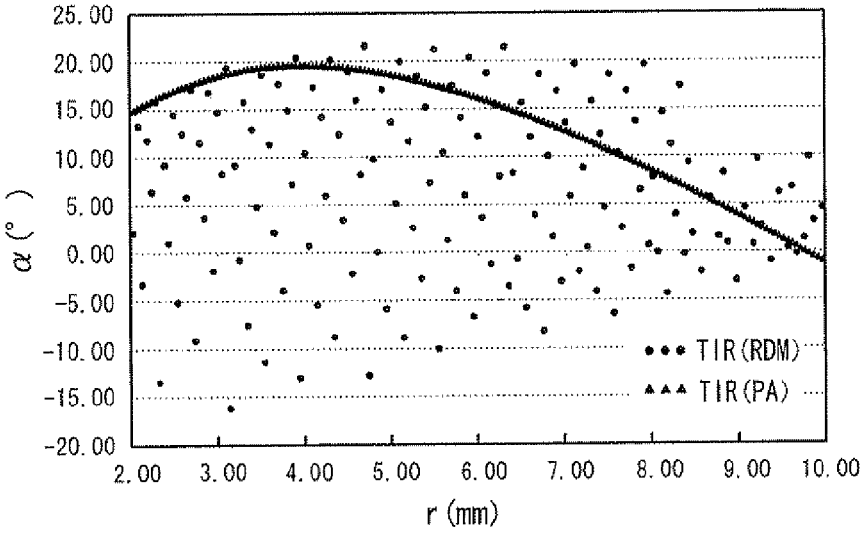

FIGS. 5, 6A and 6B show characteristics of the illuminating device 10 provided with the lens sheet 14 having the configuration shown in FIGS. 1 and 3A according to the first embodiment of the present invention. A horizontal axis represents a distance r (mm) of the first lens group 14A and the second lens group 14B from the lens center (the optical axis C of the light source 12). A vertical axis represents an output angle α (°) of the outgoing light from the lens sheet 14. It should be noted that the effect of scattering of the output angle due to the dome-shaped light scattering elements 22*a* is not reflected in data shown in FIGS. 5, 6A and 6B in order to facilitate understanding of the light path deflection due to the first lens group 14A and the second lens group 14B.

In FIGS. 5, 6A and 6B, the data corresponding to the first embodiment of the present invention is indicated by a symbol "concave". Moreover, as reference examples regarding the first lens group 14A, data corresponding to the comparative example shown in FIG. 4B is indicated by a symbol "FL", data corresponding to the comparative example shown in FIG. 4C is indicated by a symbol "convex", and data corresponding to the comparative example shown in FIG. 4D is indicated by a symbol "convex-2". Furthermore, regarding the second lens group 14B, data corresponding to the reflection prisms whose respective inclined surfaces are random in the inclination angle is indicated by a symbol TIR(RDM), and data corresponding to the reflection prisms whose respective inclined surfaces are constant in the inclination angle is indicated by a symbol TIR(PA).

Regarding the first lens group 14A of the lens sheet 14 according to the first embodiment of the present invention, a region within r=1 mm is formed as follows. That is, as in the examples shown in FIGS. 1 and 2, the distance Y between the light emitting surface 12*a* of the light source 12 and the facing surface 14*a* of the lens sheet 14 is taken into consideration, and the respective inclination angles θ1, θ2, θ3 . . . of the inclined surfaces 16*a* of the prisms 161, 162, 163 . . . are formed to decrease with distance from the optical axis C of the light source 12 such that the output angle of the outgoing light from the light source 12 that is output through the first lens group 14A is a constant value of 20° regardless of the distance from the optical axis C of the light source 12. Therefore, it can be seen that the output angle α is a constant value of 20° in the region within r=1. Meanwhile, in a region from r=1 mm to r=2 mm, the inclination angle of the inclined surface 16*a* of each prism 16 is set such that the output angle α increases monotonically.

It can be seen that the output angle α according to the first embodiment of the present invention is larger than that in the case of each comparative example over the entire region within r=2 mm in which the first lens group 14A is formed.

Moreover, it can be seen that in an entire region beyond r=2 mm in which the second lens group 14B is formed, the output angle α according to the first embodiment of the present invention is randomly distributed regardless of the distance from the optical axis C of the light source 12. Therefore, the color mixture is further facilitated by an effect of superposition of the outgoing light from the light source 12 that is output through the first lens group 14A and the outgoing light from the light source 12 that is output through the second lens group 14B arranged on the outer side of the first lens group 14A.

Figure 1B:
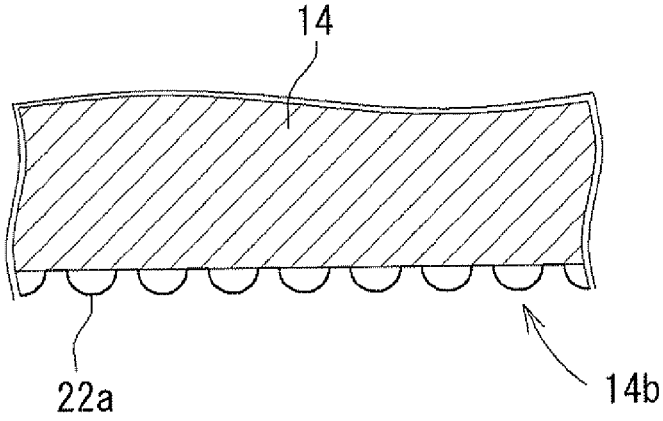
Figure 7A:
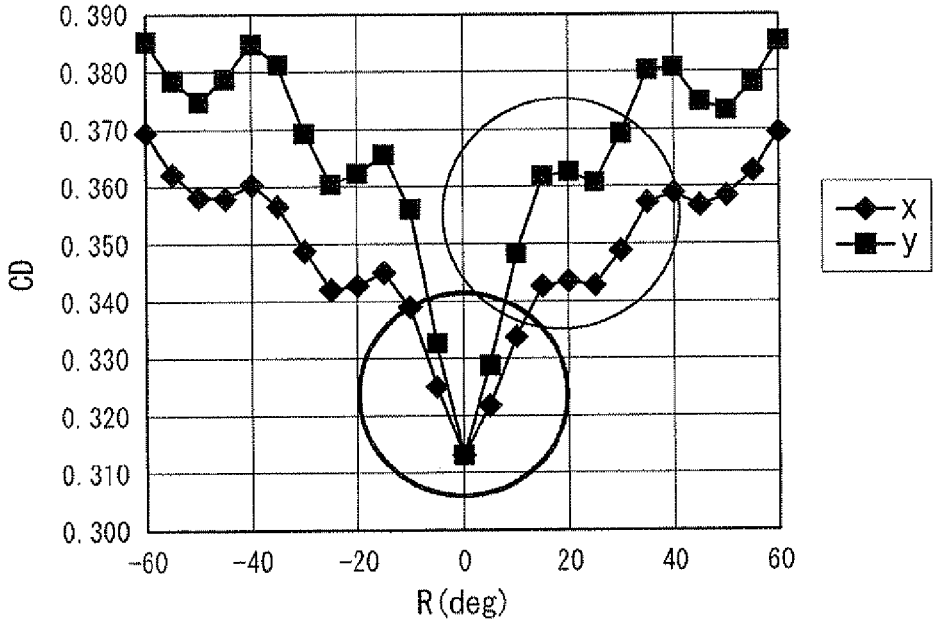
FIG. 7A is a graph showing a chromaticity distribution of illumination light of an illuminating device according to a reference example.
Figure 7B:
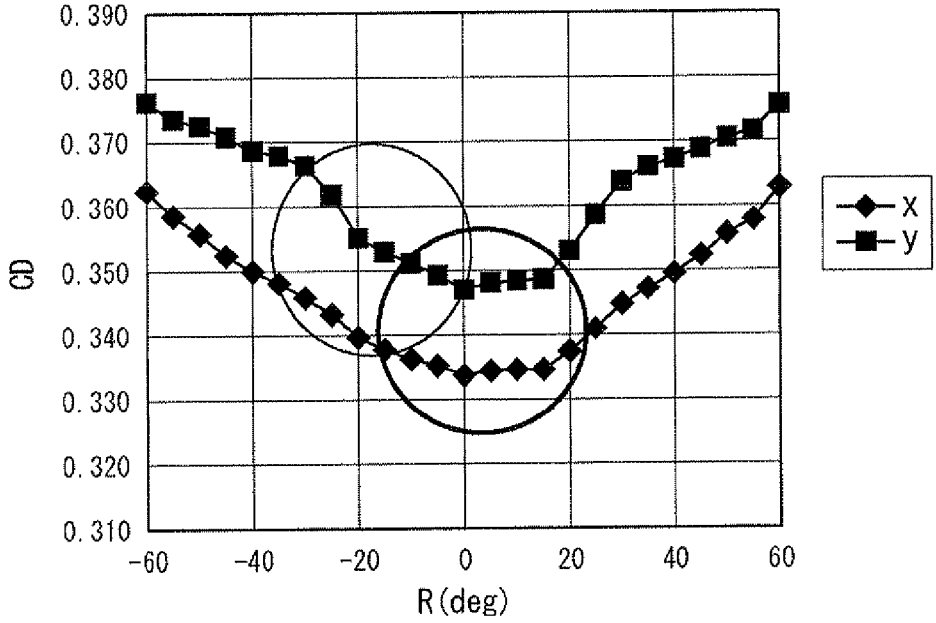
FIG. 7B is a graph showing a chromaticity distribution of illumination light of the illuminating device illustrated in FIG. 1A.

FIGS. 7A and 7B are graphs showing a comparison of measured chromaticity distribution of illumination light between two illuminating devices different in configuration. FIG. 7A shows a measurement result regarding an illuminating device in which a lens sheet having no dome-shaped light scattering element 22*a* is used instead of the lens sheet 14 shown in FIGS. 1A and 1B. FIG. 7B shows a measurement result regarding the illuminating device 10 in which the lens sheet 14 as shown in FIGS. 1A, 1B and 3A is used. In FIGS. 7A and 7B, a horizontal axis represents a directivity angle R (deg), a vertical axis represents chromaticity CD, a symbol "x" indicates the x value of chromaticity and a symbol "y" indicates the y value of chromaticity. A distance from each illuminating device to a measurement device is 1 m. As can be clearly seen from the comparison, the illuminating device 10 according to the first embodiment of the present invention has characteristics that each chromaticity value (x, y) near the directivity angle R=0 deg (indicated by a thick line circle in each graph) is larger and each chromaticity value (x, y) near the directivity angle R=20 deg (indicated by a thin line circle in each graph) is smaller as compared with the case where no dome-shaped light scattering element 22*a* is formed on the lens sheet 14. That is to say, blue chromaticity is decreased near the directivity angle R=0 deg and yellow chromaticity is decreased near the directivity angle R=20 deg. As a result, the color unevenness that has been inevitable when the pseudo white light emitting diode 100 (see FIG. 14) is used as the light source 12 of the illuminating device 10 can be further reduced. Further, the inventors of the present invention have confirmed that, when applying the lens sheet 14 on which the dome-shaped light scattering element 22*a* is formed, a so-called 'chip appearance,' which is a kind of color unevenness, could be reduced to a non-observable level. This "chip appearance" tends to occur when the plurality of the light emitting devices is positioned close to each other.

It should be noted that the same effect of reduction in the color unevenness can be expected also in the cases of the examples shown in FIGS. 3B and 3C according to the first embodiment of the present invention (disclosure of specific figures is omitted), because the first lens group 14A is provided with the plurality of prisms 16 each having the inclined surface 16*a* that is inclined so as to direct relative to the optical axis C of the light source 12 as in the case of the example shown in FIG. 3A.

According to the first embodiment of the present invention as described above, the following actions and effects can be obtained. That is, as shown in FIG. 1A, the light source 12 (100) includes: the plurality of light emitting devices (blue light-emitting diodes 102) arranged adjacent to each other; and the phosphor (yellow phosphor 108) receiving light emitted by the light emitting devices and emitting the light after converting the wavelength. The outgoing light L from the light source 12 is input to the lens sheet 14 located on the optical axis C of the light source 12. The lens sheet 14 has the plurality of prisms 16 that is formed on the facing surface 14*a* and arranged symmetrically with respect to the optical axis C of the light source 12, and the light path of the light input to the lens sheet 14 is deflected by the plurality of prisms 16. Moreover, the lens sheet 14 has the plurality of dome-shaped light scattering elements 22*a* formed on the opposite surface 14*b*. The light whose light path is deflected further travels within the lens sheet 14 and then scattered by the plurality of dome-shaped light scattering elements 22*a* in various directions, thereby deteriorated in terms of directional characteristic and output from the lens sheet 14. Therefore, color mixture of the outgoing light L output from the light source 12 through the lens sheet 14 is facilitated. As a result, the color unevenness that has been inevitable when the pseudo white light emitting diode 100 (see FIG. 14) is used as the light source 12 of the illuminating device 10 can be reduced.

Moreover, the plurality of dome-shaped light scattering elements 22*a* provided on the opposite surface 14*b* is formed in the circuit region 22S (see FIG. 2) around the optical axis C of the light source 12 and adjacent to the optical axis C of the light source 12. Therefore, a series of outgoing light from the plurality of light emitting devices that is output from near the optical axis C of the light source 12 can be especially scattered in various directions and output from the lens sheet 14. Thus, the color mixture is facilitated by an effect of superposition of the outgoing light from the light source 12 that is output through the region 22S in which the dome-shaped light scattering elements 22*a* are formed and the outgoing light from the light source 12 that is output through a region in which the dome-shaped light scattering elements 22*a* are not formed.

Moreover, the lens sheet 14 has the first lens group 14A arranged on the inner side and the second lens group 148 arranged on the outer side thereto, when the optical axis C of the light source 12 is considered as a center. The first lens group 14A has the plurality of prisms 16 each having the inclined surface 16*a* that is inclined so as to direct relative to the optical axis C of the light source 12. As a result, when the outgoing light L from the light source 12 is output from the lens sheet 14, the light path of the outgoing light L is deflected outward as seen from the optical axis C of the light source 12 by the plurality of prisms 16. Here, in order to control the deflection direction of the outgoing light L, a height of the prism 16 may be increased depending on distance from the optical axis C of the light source 12 for changing the inclination angle θn of the inclined surface 16*a*. In this case, an area of a surface 16*b* (see FIG. 2) of the prism 16 parallel to the optical axis C is increased. However, since the inclined surface 16*a* of the prism 16 of the first lens group 14A is inclined so as to direct relative to the optical axis C of the light source 12, the outgoing light L from the light source 12 is prevented from being directly input to the surface 16*b* of the prism 16 parallel to the optical axis C, which does not cause deterioration in the light use efficiency. The color mixture is facilitated by an effect of superposition of the outgoing light from the light source 12 that is output through the first lens group 14A and the outgoing light from the light source 12 that is output through the second lens group 14B arranged on the outer side of the first lens group 14A. As a result, the color unevenness that has been inevitable when the pseudo white light emitting diode 100 (see FIG. 14) is used as the light source 12 of the illuminating device 10 can be reduced.

Moreover, the plurality of prisms 161, 162, 163 . . . of the first lens group 14A is formed such that respective inclination angles θ1, θ2, θ3 . . . of the inclined surfaces 16*a* decrease with distance from the optical axis C of the light source 12 (θ1>θ2>θ3). Thus, the deflection direction can be controlled depending on the distance from the optical axis C of the light source 12 by the plurality of prisms 16 of the first lens group 14A. As shown in FIG. 2, the inclination angles θ1, θ2, θ3 . . . of the inclined surfaces 16*a* of the respective prisms 161, 162, 163 . . . are set to decrease with distance from the optical axis C of the light source 12 such that the output angle of the outgoing light L from the light source 12 that is output through the first lens group 14A of the lens sheet 14 is constant regardless of the distance from the optical axis C of the light source 12. In this manner, the color mixture can be controlled by an effect of superposition with the outgoing light from the light source 12 that is output through the second lens group 14B arranged on the outer side of the first lens group 14A.

Moreover, the second lens group 14B includes the plurality of reflection prisms 18. Therefore, in a region further away from the optical axis C of the light source 12 as compared with the first lens group 14A, the output angle of the outgoing light L from the light source 12 that is output through the second lens group 14B is deflected in a direction parallel to the optical axis C or a direction closer to the optical axis C of the light source 12. Thus, the color mixture is facilitated by an effect of superposition of the outgoing light from the light source 12 that is output through the first lens group 14A and the outgoing light from the light source 12 that is output through the second lens group 14B arranged on the outer side of the first lens group 14A.

Moreover, the third lens group 14C may be arranged between the first lens group 14A and the second lens group 14B as shown in FIG. 3B. In this case, the outgoing light L from the light source 12 is deflected also by the third lens group 14C. Here, since each of the prisms 20 of the third lens group 14C has the inclined surface 20*a* that is inclined so as to direct opposite relative to the optical axis C of the light source 12, the outgoing light L from the light source 12 is deflected when irradiated onto the inclined surface 20*a* of the third lens group 14C and thus the light path of the outgoing light L output from the lens sheet 14 is deflected in a direction parallel to the optical axis C of the light source 12 or toward the optical axis C of the light source 12 which is opposite to the deflection direction of the outgoing light L output through the first lens group 14A. Thus, the color mixture is further facilitated by an effect of superposition of the outgoing light from the light source 12 that is output through the first lens group 14A, the outgoing light from the light source 12 that is output through the second lens group 14B, and the outgoing light from the light source 12 that is output through the third lens group 14C arranged between the first lens group 14A and the second lens group 14B.

Furthermore, as shown in FIG. 3C, the second lens group 14B may have the plurality of prisms 20 each having the inclined surface 20*a* that is inclined so as to direct opposite relative to the optical axis C of the light source 12. In this case, the color mixture is facilitated by an effect of superposition of the outgoing light from the light source 12 that is output through the first lens group 14A and the outgoing light from the light source 12 that is output through the second lens group 14B, as described above. As a result, the same actions and effects can be obtained.

In the first embodiment of the present invention, the plurality of prisms 16, 18 and 20 of the respective lens groups 14A, 14B and 14C of the lens sheet 14 is arranged around the optical axis C of the light source 12 in a rotational symmetry. Thus, the color mixture of the outgoing light L from the light source 12 output through the lens sheet 14 is facilitated in all radial directions from the optical axis C of the light source 12 as a center. It should be noted that even in a case of a linear prism where each of the lens groups 14A, 14B and 14C of the lens sheet 14 is formed in a linear form, a certain level of directional characteristic is achieved and similar actions and effects can be obtained.

Here, in the illuminating device 10 according to the first embodiment of the present invention, the blue light-emitting diodes 102 of the light source 12 are positioned close to each other. In this type of light source 12, color unevenness ("chip appearance") tends to occur. However, in the present invention, as shown in FIG. 1, the plurality of dome-shaped light scattering elements is arranged at an area near or around the optical axis C of the light source 12. With this structure, the outgoing lights that are emitted from the blue light-emitting diodes 102 each closely arranged and especially that are emitted in a row at an area near the optical axis C of the light source 12 can be dispersed in various directions by means of the dome-shaped light scattering elements 22*a*. Accordingly, such color unevenness can be effectively reduced.

Moreover, the light source 12 includes: the plurality of blue light-emitting diodes 102 as the light emitting devices; and the phosphor 108 receiving light emitted by the plurality of blue light-emitting diodes 102 and producing fluorescence. That is, the light source 12 is the pseudo white light emitting diode 100 in which blue light is emitted by the plurality of blue light-emitting diodes 102 and the wavelength of the blue light is converted by the phosphor 108 into fluorescent yellow light. Then, the color mixture of the outgoing light emitted by the pseudo white light emitting diode 100 is facilitated by the prisms 16, 18 and 20 of the respective lens groups 14A, 14B and 14C and the dome-shaped light scattering elements 22*a* of the lens sheet 14, as described above. As a result, the color unevenness that has been inevitable when the pseudo white light emitting diode 100 is used can be reduced or resolved.

Next, an illuminating device 10' according to a second embodiment of the present invention will be described below with reference to FIGS. 8A to 8C, 9A and 9B. In FIGS. 8A to 8C, 9A and 9B, the same reference numerals are given to the same or similar components as those of the illuminating device 10 described in the first embodiment of the present invention. A different part between the illuminating device 10' according to the second embodiment of the present invention and the illuminating device 10 according to the first embodiment of the present invention will be described below, and some repeated descriptions of the same components, actions and effects as those of the illuminating device 10 according to the first embodiment of the present invention will be omitted.

Figure 8A:
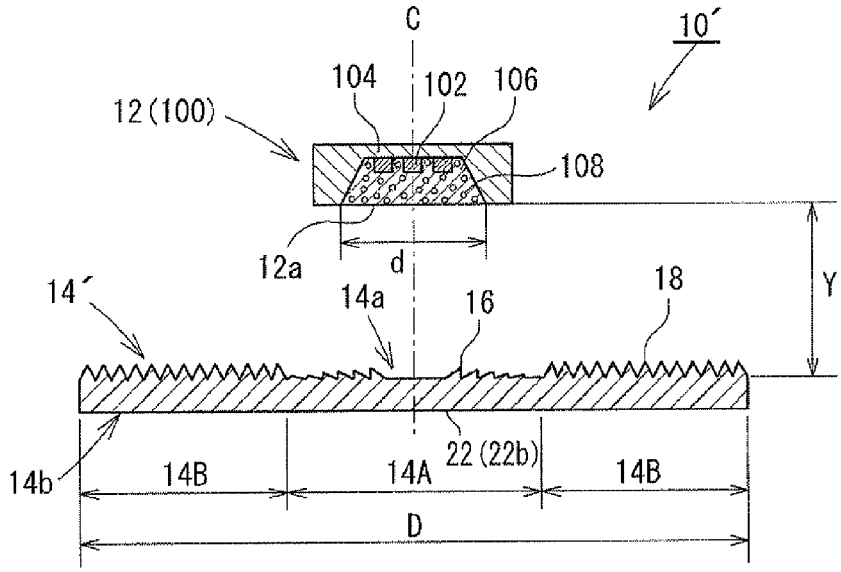
FIG. 8A is a cross-sectional view schematically illustrating a configuration of an illuminating device according to a second embodiment of the present invention.

As shown in FIG. 8A, a lens sheet 14' of the illuminating device 10' according to the second embodiment of the present invention has a plurality of prisms that is so formed on the facing surface 14*a* as to be around the optical axis C of the light source 12 in a rotational symmetry. The plurality of prisms is similar to the plurality of prisms provided on the facing surface 14*a* of the lens sheet 14 of the illuminating device 10 according to the first embodiment of the present invention (see FIG. 1A). Furthermore, the lens sheet 14' according to the second embodiment of the present invention has the plurality of light scattering elements 22 that is formed on the opposite surface 14*b* and in a circular region located adjacent to the optical axis C of the light source 12. Here, the plurality of light scattering elements 22 according to the present embodiment is a plurality of cylindrical lenses 22*b* arranged concentrically with respect to the optical axis C of the light source 12, as illustrated in a magnified manner in FIG. 8B. A lens constituted by arranging the plurality of cylindrical lenses in this manner may be referred to as a lenticular lens. Here, a convex cylindrical lens whose cross-section is as shown in FIG. 8C is used as the cylindrical lens 22*b* according to the present embodiment.

Here, a diameter D of the lens sheet 14' according to the present embodiment is preferably set to be equal to or larger than 20 mm. A diameter of the circular region in which the cylindrical lenses 22*b* are formed is preferably set in consideration of the diameter D of the lens sheet 14'. For example, when the diameter D of the lens sheet 14' is relatively small, the diameter of the circular region in which the cylindrical lenses 22*b* are formed may be set to be equal to the diameter D of the lens sheet 14' such that the cylindrical lenses 22*b* are formed on an entire surface of the opposite surface 14*b*. As another example, when the diameter D of the lens sheet 14' is relatively large, the diameter of the circular region in which the cylindrical lenses 22*b* are formed may be set to be smaller than the diameter D of the lens sheet 14'.

Figure 8B:
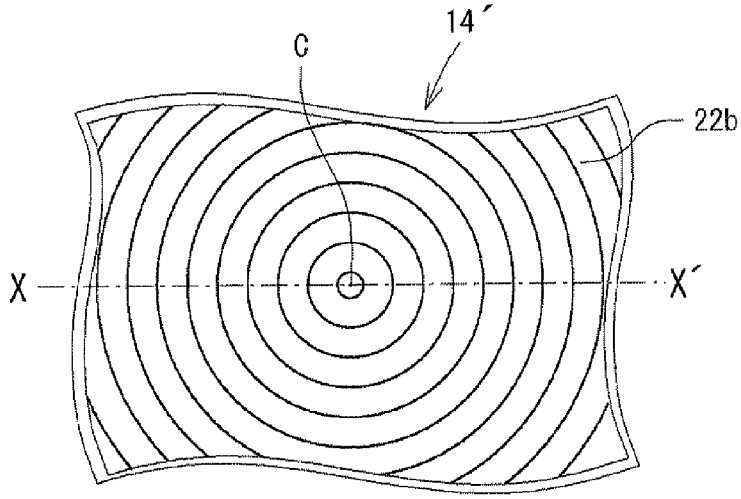
FIG. 8B is a magnified plan view of a part of an opposite surface of a lens sheet (the surface not fronting toward the light source) illustrated in FIG. 8A.
Figure 8C:
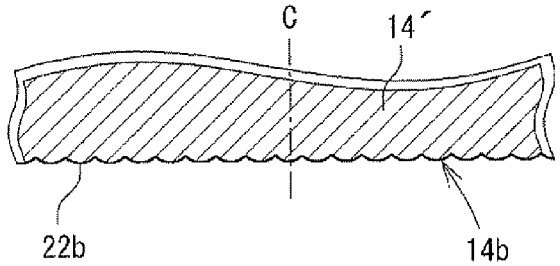
FIG. 8C is a cross-sectional view taken along a line X-X' in FIG. 8B.
Figure 9A:
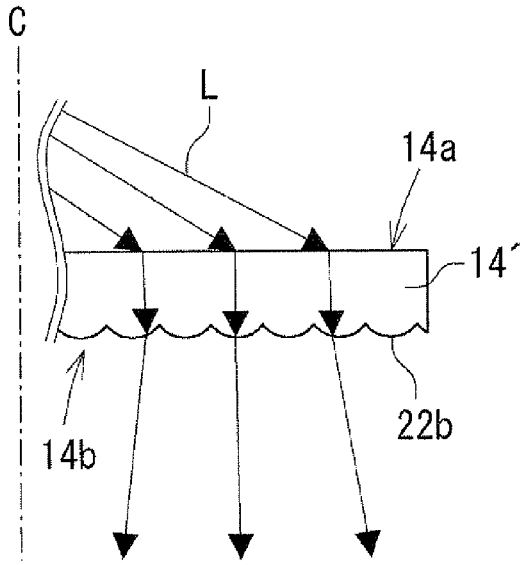
Figure 9B:
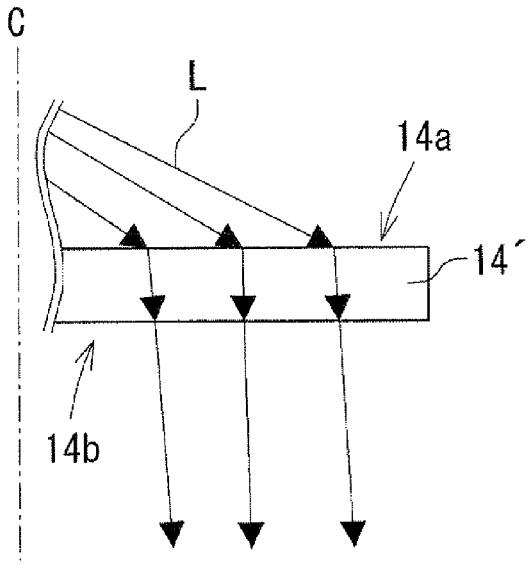

FIGS. 9A and 9B schematically show a magnified cross-section of a part of the lens sheet 14' of the illuminating device 10' shown in FIGS. 8A to 8C together with the light path of the outgoing light from the light source 12. Specifically, FIG. 9A shows the light path of the outgoing light output through the lens sheet 14' in which the cylindrical lenses 22*b* are provided on the opposite surface 14*b*. FIG. 9B shows the light path of the outgoing light output through the lens sheet 14' in which the cylindrical lenses 22*b* are not provided on the opposite surface 14*b*, which is a comparative example. In FIGS. 9A and 9B, the light source 12 is located on the left-hand side in each diagram. The plurality of prisms provided on the facing surface 14*a* of the lens sheet 14' is not illustrated for simplicity. In the lens sheet 14' according to the second embodiment of the present invention shown in FIG. 9A, a cross-sectional curvature radius of each of the cylindrical lenses 22*b* is uniformly set to be about 0.1 mm, and an arrangement interval of the cylindrical lenses 22*b* is uniformly set to be about 0.15 mm.

In FIGS. 9A and 9B, three lines of outgoing light L from the light source 12 are illustrated for simplicity. In the case of the lens sheet 14' according to the comparative example shown in FIG. 9B, the outgoing light L from the light source 12 is deflected in the light path by the plurality of prisms provided on the facing surface 14*a* and then travels within the lens sheet 14'. Then, the outgoing light L reaches the opposite surface 14*b*. However, there is nothing in particular on the opposite surface 14*b*. Therefore, the outgoing light L is output from the lens sheet 14' with its light path slightly deflected due to light refraction at the opposite surface 14*b* of the lens sheet 14'.

In the case of the lens sheet 14' according to the present embodiment shown in FIG. 9A, on the other hand, the outgoing light L from the light source 12 travels along the same light path as in the case of the comparative example until it reaches the opposite surface 14*b*. Then, the light path of each outgoing light L is deflected in a positive manner by the plurality of cylindrical lenses 22*b* provided on the opposite surface 14*b*. Here, details of the light path of each outgoing light L are as follows. The light path of the outgoing light L illustrated on the right-hand side in FIG. 9A is deflected by the prisms provided on the facing surface 14*a* to be slightly outward (toward the right-hand side) as seen from the optical axis C of the light source 12 and then deflected further outward (toward the right-hand side) as seen from the optical axis C of the light source 12 by the cylindrical lenses 22*b* provided on the opposite surface 14*b*. The light path of the outgoing light L illustrated in the center in FIG. 9A is deflected by the prisms provided on the facing surface 14*a* to be substantially parallel to the optical axis C of the light source 12 and then deflected slightly outward (toward the right-hand side) as seen from the optical axis C of the light source 12 by the cylindrical lenses 22*b* provided on the opposite surface 14*b*. The light path of the outgoing light L illustrated on the left-hand side in FIG. 9A is deflected by the prisms provided on the facing surface 14*a* to be slightly outward (toward the right-hand side) as seen from the optical axis C of the light source 12 and then deflected inward (toward the left-hand side) as seen from the optical axis C of the light source 12 by the cylindrical lenses 22*b* provided on the opposite surface 14*b*.

In this manner, in the case of the lens sheet 14' (FIG. 9A) according to the second embodiment of the present invention, the light path of the outgoing light L from the light source 12 is deflected to much more various directions as compared with the case of the lens sheet 14' (FIG. 9B) according to the comparative example.

It should be noted here that although the sectional curvature and the arrangement interval of the plurality of cylindrical lenses 22*b* provided on the lens sheet 14' are uniformly set in the example shown in FIG. 9A, they are not limited to that. According to the present embodiment, the sectional curvature and the arrangement interval of the plurality of cylindrical lenses 22*b* provided on the lens sheet 14' can be adjusted as appropriate. Such the adjustment enables adjustment of the light deflection angle when the outgoing light L from the light source 12 passes through the cylindrical lenses 22*b*. Therefore, the outgoing light L from the light source 12 passing through the lens sheet 14' according to the present embodiment is deflected in various directions within a range where a spread angle of the light path is controlled.

Let us consider a case where the measurement of the chromaticity distribution of illumination light, which yields the result shown in FIG. 7B when performed with respect to the illuminating device 10 according to the first embodiment of the present invention, is performed with respect to the illuminating device 10' according to the second embodiment of the present invention (disclosure of concrete data is omitted). In the illuminating device 10' according to the second embodiment of the present invention, the plurality of cylindrical lenses 22*b* as the plurality of light scattering elements 22 is formed on the opposite surface 14*b* of the lens sheet 14'. Therefore, the measurement of the chromaticity distribution of illumination light of the illuminating device 10' according to the second embodiment of the present invention is expected to have a result that the color unevenness is reduced to the same extent as the measurement result shown in FIG. 7B in the case where the dome-shaped light scattering elements 22*a* are formed. Such the measurement of the chromaticity distribution may be repeated to adjust the sectional curvature and the arrangement interval of the cylindrical lenses 22*b* such that the measurement result is improved. In this case, the color unevenness is expected to be reduced more efficiently.

According to the second embodiment of the present invention as described above, the following actions and effects can be obtained. That is, as shown in FIGS. 8A to 8C, in the illuminating device 10' according to the second embodiment of the present invention, the plurality of light scattering elements 22 formed on the opposite surface 14*b* is the plurality of cylindrical lenses 22*b* arranged concentrically with respect to the optical axis C of the light source 12. The outgoing light L from the light source 12 is input to the lens sheet 14' and the light path of the input light is first deflected by the plurality of prisms formed on the facing surface 14*a* of the lens sheet 14'. The light whose light path is deflected further travels within the lens sheet 14' and then scattered in various directions by the plurality of cylindrical lenses 22*b* provided on the opposite surface 14*b* of the lens sheet 14', as shown in FIG. 9A, thereby deteriorated in terms of directional characteristic and output from the lens sheet 14'. Furthermore, by adjusting the sectional curvature and the arrangement interval of the plurality of cylindrical lenses 22*b*, the light output from the opposite surface 14*b* of the lens sheet 14' is controlled in its spread angle. Thus, the color mixture is facilitated while suppressing the spread angle of the outgoing light L from the light source 12 output through the lens sheet 14'. As a result, the color unevenness that has been inevitable when the pseudo white light emitting diode 100 (see FIG. 14) is used as the light source 12 of the illuminating device 10' can be reduced.

Moreover, as shown in FIGS. 8A to 8C, the plurality of prisms formed on the facing surface 14*a* of the lens sheet 14' is arranged symmetrically with respect to the optical axis C of the light source 12, and the plurality of cylindrical lenses 22*b* formed on the opposite surface 14*b* of the lens sheet 14' is arranged concentrically with respect to the optical axis C of the light source 12, namely, concentric lenticular lenses are provided. Therefore, the illuminating device 10' having the lens sheet 14' can achieve an illumination distribution having excellent rotational symmetry near the optical axis C of the light source 12.

Moreover, in the illuminating device 10' according to the second embodiment of the present invention, the plurality of cylindrical lenses 22*b* formed on the opposite surface 14*b* of the lens sheet 14' includes a cylindrical lens 22*b* whose sectional curvature is different from that of an adjacent cylindrical lens 22*b*. For example, when the sectional curvature of the cylindrical lens 22*b* is changed depending on distance from the optical axis C of the light source 12, the spread angle of the outgoing light L can be controlled depending on the chromaticity distribution of the outgoing light L from the light source 12. As another example, when the sectional curvature of the cylindrical lens 22*b* is set in a random manner as appropriate, the outgoing light from the light source 12 output through the region in which the cylindrical lenses 22*b* are formed is subject to color mixture in a random manner in that region. Furthermore, the color mixture is facilitated by an effect of superposition with the outgoing light from the light source 12 that is output through a region in which the cylindrical lenses 22*b* are not formed.

In the illuminating device 10' according to the second embodiment of the present invention, each of the plurality of cylindrical lenses 22*b* provided on the opposite surface 14*b* of the lens sheet 14' is the convex cylindrical lens as shown in FIG. 8C. The same actions and effects as those described above can be obtained even when each of the plurality of cylindrical lenses 22*b* is a concave cylindrical lens.

Next, an illuminating device 10" according to a third embodiment of the present invention will be described below with reference to FIGS. 10A to 10C, 11A and 11B. In FIGS. 10A to 10C, 11A and 11B, the same reference numerals are given to the same or similar components as those of the illuminating device 10 described in the first embodiment of the present invention. A different part between the illuminating device 10" according to the third embodiment of the present invention and the illuminating device 10 according to the first embodiment of the present invention will be described below, and an overlapping description of the same components, actions and effects as those of the illuminating device 10 according to the first embodiment of the present invention will be omitted.

Figure 10A:
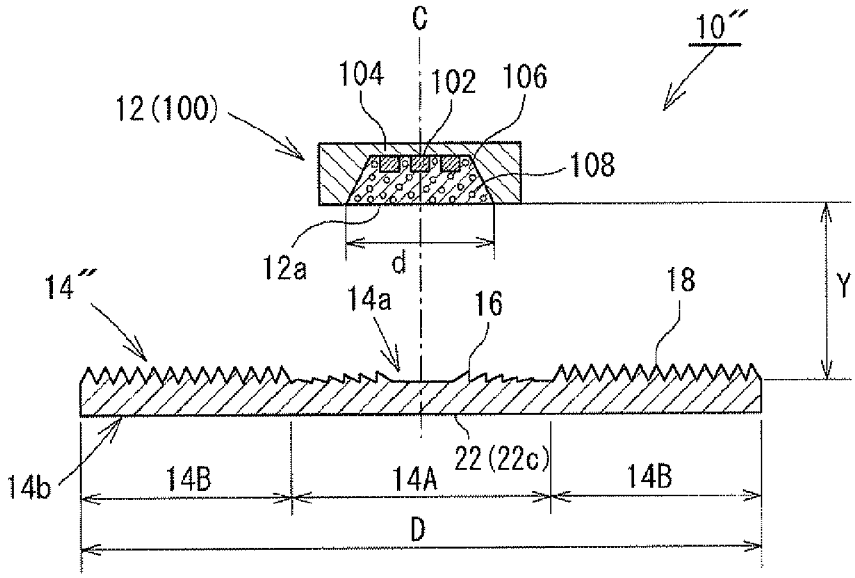
FIG. 10A is a cross-sectional view schematically illustrating a configuration of an illuminating device according to a third embodiment of the present invention.

As shown in FIG. 10A, a lens sheet 14" of the illuminating device 10" according to the third embodiment of the present invention has a plurality of prisms that is so formed on the facing surface 14*a* as to be around the optical axis C of the light source 12 in a rotational symmetry. The plurality of prisms is similar to the plurality of prisms provided on the facing surface 14*a* of the lens sheet 14 of the illuminating device 10 according to the first embodiment of the present invention (see FIG. 1A). Furthermore, the lens sheet 14" according to the third embodiment of the present invention has the plurality of light scattering elements 22 that is formed on the opposite surface 14*b* and in a region located adjacent to the optical axis C of the light source 12. Here, the plurality of light scattering elements 22 according to the present embodiment is a plurality of micro lenses 22*c*. As illustrated in a magnified manner in FIG. 10C, the plurality of micro lenses 22*c*, each of which has a hexagonal shape in a planar view, is arranged in a houndstooth pattern on a surface orthogonal to the optical axis C of the light source 12. A lens constituted by arranging the plurality of micro lenses in this manner may be referred to as a fly eye lens. Here, a convex lens whose cross-section is as shown in FIG. 10C is used as the micro lens 22*c* according to the present embodiment.

Here, a diameter D of the lens sheet 14" according to the present embodiment is preferably set to be equal to or larger than 20 mm. A diameter of the region in which the micro lenses 22*c* are formed is preferably set in consideration of the diameter D of the lens sheet 14". For example, when the diameter D of the lens sheet 14" is relatively small, the region in which the micro lenses 22*c* are formed may be formed to have a circular shape such that the micro lenses 22*c* are formed on an entire surface of the opposite surface 14*b* of the lens sheet 14". As another example, when the diameter D of the lens sheet 14" is relatively large, the region in which the micro lenses 22*c* are formed may be formed to have a circular shape near the optical axis C of the light source 12 whose diameter is smaller than the diameter D of the lens sheet 14".

Figure 10B:
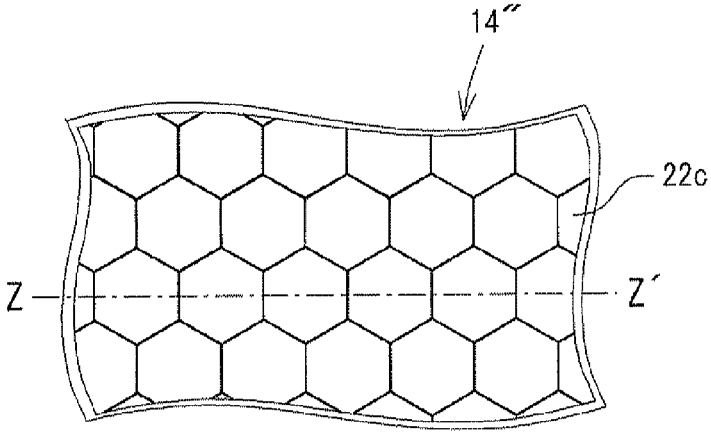
FIG. 10B is a magnified plan view of a part of an opposite surface of a lens sheet (the surface not fronting toward the light source) illustrated in FIG. 10A.
Figure 10C:
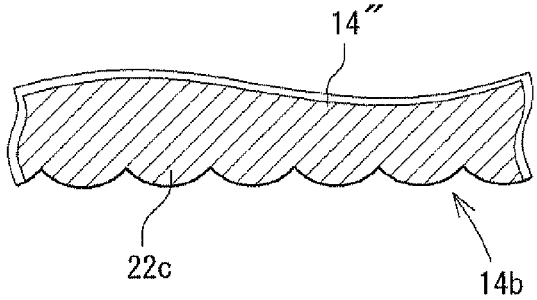
FIG. 10C is a cross-sectional view taken along a line Z-Z' in FIG. 10B.
Figure 11A:
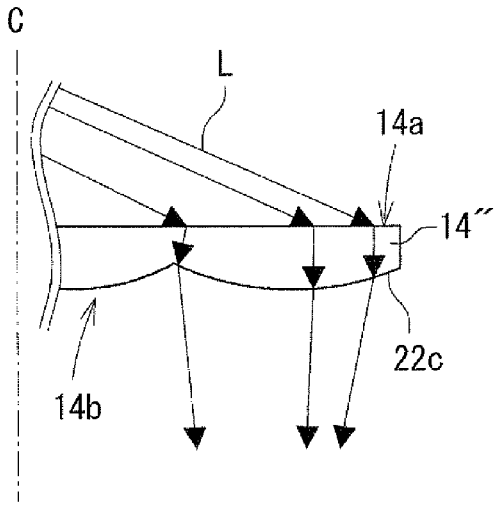
Figure 11B:
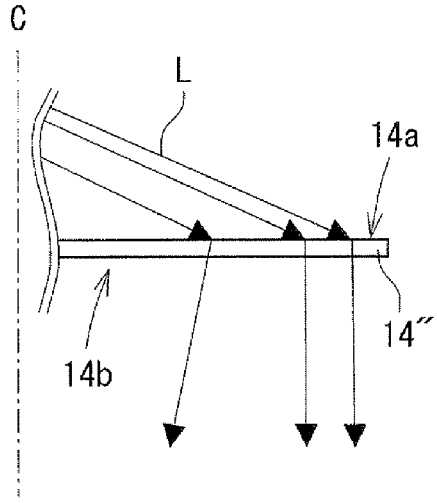

FIGS. 11A and 11B schematically show a magnified cross-section of a part of the lens sheet 14" of the illuminating device 10" shown in FIGS. 10A to 10C together with the light path of the outgoing light from the light source 12. Specifically, FIG. 11A shows the light path of the outgoing light output through the lens sheet 14" in which the micro lenses 22*c* are provided on the opposite surface 14*b*. FIG. 11B shows the light path of the outgoing light output through the lens sheet 14" in which the micro lenses 22*c* are not provided on the opposite surface 14*b*, which is a comparative example. In FIGS. 11A and 11B, the light source 12 is located on the left-hand side in each diagram. The plurality of prisms provided on the facing surface 14*a* of the lens sheet 14" is not illustrated for simplicity. In the lens sheet 14" according to the third embodiment of the present invention shown in FIG. 11A, a cross-sectional curvature radius of each of the micro lenses 22*c* is uniformly set to be about 0.1 mm, and an arrangement interval of the micro lenses 22*c* is uniformly set to be about 0.1 mm.

In FIGS. 11A and 11B, three lines of outgoing light L from the light source 12 are illustrated for simplicity. In the case of the lens sheet 14" according to the comparative example shown in FIG. 11B, the outgoing light L from the light source 12 is deflected in the light path by the plurality of prisms provided on the facing surface 14*a* and then travels within the lens sheet 14". Then, the outgoing light L reaches the opposite surface 14*b*. However, there is nothing in particular on the opposite surface 14*b*. Therefore, the outgoing light L is output from the lens sheet 14" with its light path hardly deflected.

In the case of the lens sheet 14" according to the present embodiment shown in FIG. 11A, on the other hand, the outgoing light L from the light source 12 travels along the same light path as in the case of the comparative example until it reaches the opposite surface 14*b* of the lens sheet 14". Then, the light path of each outgoing light L is deflected in a positive manner by the plurality of micro lenses 22*c* provided on the opposite surface 14*b*. Here, details of the light path of each outgoing light L are as follows. The light path of the outgoing light L illustrated on the right-hand side in FIG. 11A is deflected by the prisms provided on the facing surface 14*a* to be substantially parallel to the optical axis C of the light source 12 and then deflected inward (toward the left-hand side) as seen from the optical axis C of the light source 12 by the micro lenses 22*c* provided on the opposite surface 14*b*. The light path of the outgoing light L illustrated in the center in FIG. 11A is deflected by the prisms provided on the facing surface 14*a* to be substantially parallel to the optical axis C of the light source 12 and then deflected slightly inward (toward the left-hand side) as seen from the optical axis C of the light source 12 by the micro lenses 22*e* provided on the opposite surface 14*b*. The light path of the outgoing light L illustrated on the left-hand side in FIG. 11A is deflected by the prisms provided on the facing surface 14*a* to be inward (toward the left-hand side) as seen from the optical axis C of the light source 12 and then deflected outward (toward the right-hand side) as seen from the optical axis C of the light source 12 by the micro lenses 22*c* provided on the opposite surface 14*b*.

In this manner, in the case of the lens sheet 14" (FIG. 11A) according to the third embodiment of the present invention, the light path of the outgoing light L from the light source 12 is deflected to much more various directions as compared with the case of the lens sheet 14" (FIG. 11B) according to the comparative example.

It should be noted here that although the sectional curvature and the arrangement interval of the plurality of micro lenses 22*c* provided on the lens sheet 14" are uniformly set in the example shown in FIG. 11A, they are not limited to that. According to the present embodiment, the sectional curvature and the arrangement interval of the plurality of micro lenses 22*c* provided on the lens sheet 14" can be adjusted as appropriate. Moreover, according to the present embodiment, the arrangement pattern of the plurality of micro lenses 22*c* provided on the lens sheet 14" is not limited to the houndstooth pattern as shown in FIG. 10B but can be adjusted to be a matrix pattern, a concentric pattern and the like. Such the adjustment enables adjustment of the light deflection angle when the outgoing light L from the light source 12 passes through the micro lenses 22*c*. Therefore, the outgoing light L from the light source 12 passing through the lens sheet 14" according to the present embodiment is deflected in various directions within a range where a spread angle of the light path is controlled.

Let us consider a case where the measurement of the chromaticity distribution of illumination light, which has the result shown in FIG. 7B when performed with respect to the illuminating device 10 according to the first embodiment of the present invention, is performed with respect to the illuminating device 10" according to the third embodiment of the present invention (disclosure of concrete data is omitted). In the illuminating device 10" according to the third embodiment of the present invention, the plurality of micro lenses 22*e* arranged in a houdstooth pattern is formed as the plurality of light scattering elements 22 on the opposite surface 14*b* of the lens sheet 14". Therefore, the measurement in this case is expected to have a result that the color unevenness is reduced to the same extent as the measurement result shown in FIG. 7B in the case where the dome-shaped light scattering elements 22*a* are formed. Such the measurement of the chromaticity distribution may be repeated to adjust the sectional curvature, the arrangement interval and the arrangement pattern of the micro lenses 22*c* for further improvement of the measurement result. In this case, the color unevenness is expected to be reduced more efficiently.

In the illuminating device 10" according to the third embodiment of the present invention, as shown in FIGS. 10A to 10C, the plurality of light-scattering elements 22 formed on the opposite surface 14*b* is the plurality of micro lenses 22*c* that is regularly arranged on a surface orthogonal to the optical axis C of the light source 12. The outgoing light L from the light source 12 is input to the lens sheet 14" and the light path of the input light is first deflected by the plurality of prisms formed on the facing surface 14*a* of the lens sheet 14". The light whose light path is deflected further travels within the lens sheet 14" and then scattered in various directions by the plurality of micro lenses 22*c* provided on the opposite surface 14*b* of the lens sheet 14", as shown in FIG. 11A, thereby deteriorated in terms of directional characteristic and output from the lens sheet 14". Furthermore, by adjusting the sectional curvature and the arrangement pattern of the plurality of micro lenses 22*c*, the light output from the opposite surface 14*b* of the lens sheet 14" is controlled in its spread angle. Thus, the color mixture is facilitated while suppressing the spread angle of the outgoing light L from the light source 12 output through the lens sheet 14". As a result, the color unevenness that has been inevitable when the pseudo white light emitting diode 100 (see FIG. 14) is used as the light source 12 of the illuminating device 10" can be reduced.

Moreover, in the illuminating device 10" according to the third embodiment of the present invention, the plurality of micro lenses 22*c* provided on the opposite surface 14*b* is arranged in a houndstooth pattern as shown in FIG. 10B. Thus, the micro lenses 22*c* are more densely arranged. In the case where each of the micro lenses 22*c* is formed to have a hexagonal shape in a planar view as illustrated, each micro lens 22*e* is arranged in close contact with outer periphery of adjacent micro lens 22*c*, and thereby the micro lenses 22*c* are arranged closely together.

In the illuminating device 10" according to the third embodiment of the present invention, each of the plurality of micro lenses 22*c* provided on the opposite surface 14*b* of the lens sheet 14" is the convex lens as shown in FIG. 10C. The same actions and effects as those described above can be obtained even when each of the plurality of micro lenses 22*b* is a concave lens.

Figure 12:
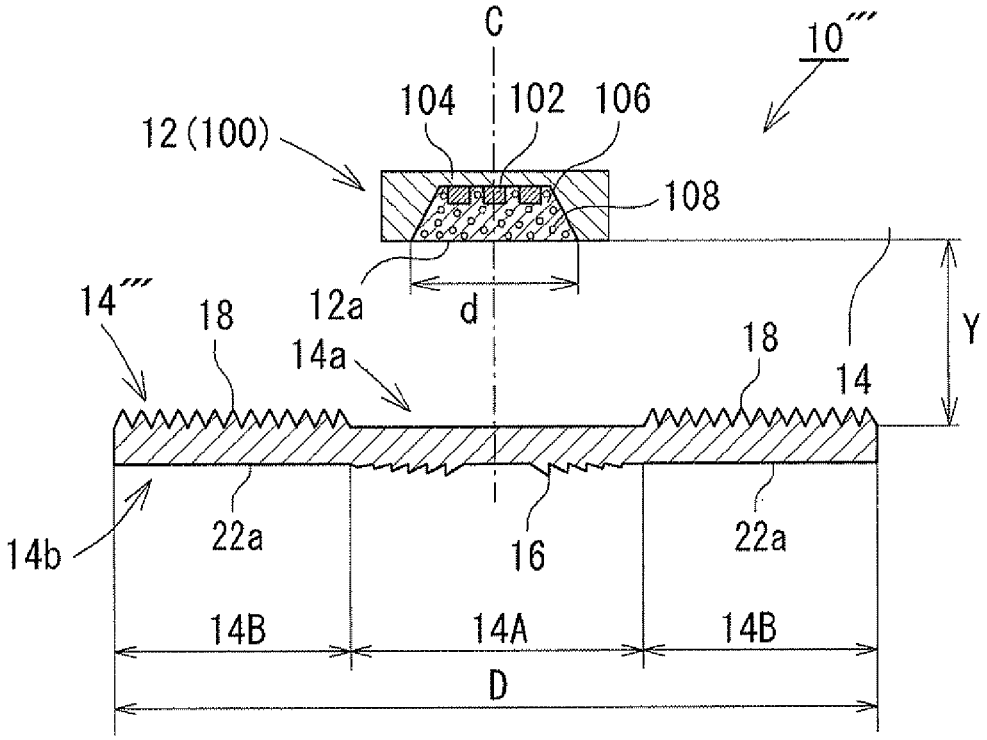
FIG. 12 is a cross-sectional view schematically illustrating the configuration of an illuminating device according to a fourth embodiment of the present invention.

Here, the illuminating device of the present invention is also applicable in a fourth embodiment. See FIG. 12. In an illuminating device 10'" of the fourth embodiment, a plurality of reflection prisms 18 that is composed of a second lens group 14B is formed on a facing surface 14*a* of a lens sheet 14'" that stays on the optical axis C of the light source 12. As shown in FIG. 12, the reflection prisms 18 is formed at an outer edge region on the lens sheet 14'" relative to the optical axis of the light source. Further, on an opposite surface 14*b* of the lens sheet 14'", the plurality of prisms 16 that is composed of a first lens group 14A is formed around the optical axis C of the light source 12. Further, a plurality of dome-shaped light scattering elements 22*a* is formed in such a manner as to surround the prisms 16. Still further, if necessary, the plurality of dome-shaped light scattering elements 22*a* may be provided on a flat surface area in which to face the light source 12 and to be around the optical axis C of the light source 12.

Here, as shown in FIG. 12, in case that the plurality of prisms is formed on the opposite surface 14*b* of the lens sheet 14'" in which not to face the light source 12, a flat portion 22*a* may be provided between each prism 16. The plurality of dome-shaped light scattering elements 22*a* may be provided on each flat portion 22*a*. See a lens sheet 214 of FIG. 13A. Specifically, each prim and the flat portion with the dome-shaped light scattering elements 22*a* are concentrically arranged with respect to the optical axis C of the light source 12 and also are alternately provided in a radial direction of the lens sheet 214. Accordingly, light that passes through the lens sheet 214 has: 1) outgoing light to be reflected in a direction depending on the configuration of prisms 16; and 2) outgoing light that passes through the flat portion placed adjacent to each prism 16 of the lens sheet 214 so as to diffuse in various directions by means of the plurality of dome-shaped light scattering elements 22*a*. Color mixture is further advanced based on these outgoing lights.

Figure 13A:
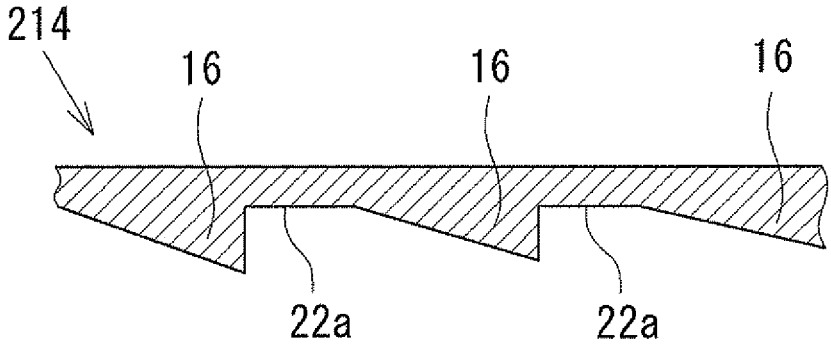
FIG. 13A is a lens sheet with a flat portion on which the light scattering elements are formed.
Figure 13B:
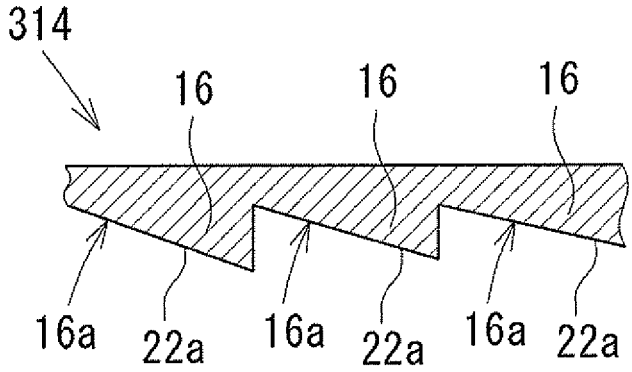
FIG. 13B is a lens sheet with prisms, whose each inclined surface has the light scattering elements.

Moreover, in case that the plurality of prisms is formed on the surface of the lens sheet in which not to face the light source, the lens sheet may have a configuration as shown in FIG. 13B. Here, the plurality of the dome-shaped light scattering elements 22*a* is formed on each inclined surface 16*a* of the prisms 16. When light passes through such prisms 16, the outgoing light that has been emitted from the light source 12 is deflected in a direction depending on the configuration of each prism 16. Further, while keeping the deflected direction, the outgoing light is adapted to diffuse in various directions by means of the plurality of dome-shaped light scattering elements 22*a*. As the same, color mixture is further advanced.

In the embodiments of the present invention, the plurality of prisms is formable not only on the surface of the lens sheet that is opposite relative to the surface on which the plurality of light scattering elements are formed but also on both surfaces of the lens sheet. In this case, the plurality of light scattering elements 22 may be formed on an area where the prisms are not formed. See FIG. 12. Or, as shown in FIG. 13A, the light scattering elements 22 may be formed on the flat portion 22*a* provided between each adjacent prism. Further, as shown in FIG. 13B, the plurality of light scattering elements 22*a* may be provided on each inclined surface 16*a* of the prisms 16. Of course, the plurality of light scattering elements is allowed to be provided on the surface of the lens sheet in which to face the light source.

In the illuminating device according to the embodiments of the present invention, the plurality of light scattering elements arranged on the lens sheet is not limited to have a configuration of 1) the dome-shaped light scattering elements 22*a* as shown in FIG. 1 and FIG. 13; 2) the cylindrical lenses 22*b* as shown in FIG. 8 and FIG. 9; and the micro lenses 22*c* as shown in FIG. 10 and FIG. 11. Any kinds and any shapes of light scattering elements will be applicable as long as they obtain the same or similar functional effects as described hereinabove. That is, in case that the light scattering elements are provided at the outer edge region on the lens sheet relative to the optical axis of the light source as shown in FIG. 12, or in case that the light scattering elements are provided on the flat portion between each adjacent prism or on the inclined surface of the prism, the plurality of light scattering elements may be the cylindrical lenses 22*b*, the micro lenses 22*c*, and the like. Further, optionally-selected plural number of light scattering elements may be taken, such as from the dome-shaped light scattering elements 22*a*, the cylindrical lenses 22*b*, the micro lenses 22*c*, or any other types of light scattering elements.

Lastly, although FIG. 1A, FIG. 8A, FIG. 10A and FIG. 12 exemplify a case where the first lens group 14A has the plurality of prisms 16 formed into concave Fresnel lenses. The concave Fresnel lenses may be however replaced by the plurality of prisms 20 formed into convex Fresnel lenses. The concave Fresnel lenses and the convex Fresnel lenses are of course applicable in combination.

What is claimed is:

1. An illuminating device comprising:

a light source that includes a plurality of light emitting devices and a phosphor; and a lens sheet that stays on an optical axis of the light source, the lens sheet having a plurality of prisms that is symmetrically arranged with respect to the optical axis of the light source, wherein the plurality of prisms is configured at least on a surface of the lens sheet in which to face the light source, a plurality of light scattering elements is configured at least on a surface of the lens sheet in which not to face the light source, the lens sheet comprises a first lens group arranged next to the optical axis of the light source, and a second lens group arranged so as to surround the first lens group, each of the first and second lens groups including prisms of the plurality of prisms, the first lens group includes a plurality of refraction prisms, the refraction prisms being configured to have a region in which each output angle thereof continuously increases with distance from the optical axis of the light source, and the second lens group includes a plurality of reflection prisms, the reflection prisms being configured to have a region in which each output angle thereof randomly changed regardless of the distance from the optical axis of the light source.

2. The illuminating device according to claim 1, wherein the plurality of light scattering elements of the lens sheet is formed in a region adjacent to the optical axis of the light source.

3. The illuminating device according to claim 1, wherein the plurality of light scattering elements is formed at an outer edge region on the lens sheet relative to the optical axis of the light source.

4. The illuminating device according to claim 1, wherein the plurality of light scattering elements each has a configuration that includes a dome shape.

5. The illuminating device according to claim 1, wherein the plurality of light scattering elements includes a plurality of cylindrical lenses arranged concentrically with respect to the optical axis of the light source.

6. The illuminating device according to claim 5, wherein the plurality of cylindrical lenses includes certain cylindrical lenses having a sectional curvature that is different from other cylindrical lenses adjacent thereto.

7. The illuminating device according to claim 5, wherein each of the plurality of cylindrical lenses is a convex cylindrical lens.

8. The illuminating device according to claim 5, wherein each of the plurality of cylindrical lenses is a concave cylindrical lens.

9. The illuminating device according to claim 1, wherein the plurality of light scattering elements includes a plurality of micro lenses regularly arranged on a surface orthogonal to the optical axis of the light source.

10. The illuminating device according to claim 9, wherein the plurality of micro lenses is arranged in a houndstooth pattern.

11. The illuminating device according to claim 9, wherein each of the plurality of micro lenses is a convex lens.

12. The illuminating device according to claim 9, wherein each of the plurality of micro lenses is a concave lens.

13. The illuminating device according to claim 1, wherein the lens sheet comprises: a first lens group; and a second lens group arranged on an outer side of the first lens group with the optical axis of the light source as a center, wherein the first lens group comprises a plurality of prisms each having an inclined surface, which is inclined so as to direct relative to the optical axis of the light source.

14. The illuminating device according to claim 13, wherein the plurality of prisms of the first lens group is formed such that an inclination angle of the inclined surface decreases with distance from the optical axis of the light source.

15. The illuminating device according to claim 13, wherein the second lens group comprises a plurality of reflection prisms.

16. The illuminating device according to claim 15, wherein the lens sheet further comprises a third lens group arranged between the first lens group and the second lens group, the third lens group including a plurality of prisms each having an inclined surface, which is inclined so as to direct opposite relative to the optical axis of the light source.

17. The illuminating device according to claim 13, wherein the second lens group comprises a plurality of prisms each having an inclined surface, which is inclined so as to direct opposite relative to the optical axis of the light source.

18. The illuminating device according to claim 13, wherein the plurality of prisms of each lens group is arranged near the optical axis of the light source in a rotational symmetry.

19. The illuminating device according to claim 1, wherein each of the plurality of light emitting devices is a blue light-emitting diode, and the phosphor converts a wavelength of blue light emitted by the blue light-emitting diode into fluorescent yellow light.

20. An illuminating device comprising:

a light source that includes a plurality of light emitting devices and a phosphor; and a lens sheet that stays on an optical axis of the light source, the lens sheet having a plurality of prisms that is symmetrically arranged with respect to the optical axis of the light source, wherein the plurality of prisms is configured at least on a surface of the lens sheet in which to face the light source, a plurality of light scattering elements is configured at least on a surface of the lens sheet in which not to face the light source, the plurality of light scattering elements includes a plurality of cylindrical lenses arranged concentrically with respect to the optical axis of the light source, and the plurality of cylindrical lenses includes certain cylindrical lenses having a sectional curvature that is different from other cylindrical lenses adjacent thereto.

21. A lens sheet that stays on an optical axis of a light source that includes a plurality of light emitting devices and a phosphor, comprising:

a plurality of prisms that is symmetrically arranged with respect to the optical axis of the light source, the plurality of prisms being configured at least on a surface of the lens sheet in which to face the light source;

a plurality of light scattering elements being configured at least on a surface of the lens sheet in which not to face the light source, wherein the lens sheet comprises a first lens group arranged next to the optical axis of the light source, and a second lens group arranged so as to surround the first lens group, each of the first and second lens groups including prisms of the plurality of prisms, the first lens group includes a plurality of refraction prisms, the refraction prisms being configured to have a region in which each output angle thereof continuously increases with distance from the optical axis of the light source, and the second lens group includes a plurality of reflection prisms, the reflection prisms being configured to have a region in which each output angle thereof is randomly changed regardless of the distance from the optical axis of the light source.

* * * * *